US010513876B2

(12) United States Patent
Molloy et al.

(10) Patent No.: US 10,513,876 B2
(45) Date of Patent: Dec. 24, 2019

(54) CLOSURE MECHANISM

(71) Applicant: ASSA ABLOY NEW ZEALAND LIMITED, Albany (NZ)

(72) Inventors: Bryce Alan Molloy, Auckland (NZ); Brenda Clare Ryan, Auckland (NZ)

(73) Assignee: ASSA ABLOY NEW ZEALAND LIMITED, Albany (NZ)

( * ) Notice: Subject to any disclaimer, the term of this patent is extended or adjusted under 35 U.S.C. 154(b) by 0 days.

(21) Appl. No.: 15/748,431

(22) PCT Filed: Jul. 29, 2016

(86) PCT No.: PCT/NZ2016/050120
§ 371 (c)(1),
(2) Date: Jan. 29, 2018

(87) PCT Pub. No.: WO2017/018890
PCT Pub. Date: Feb. 2, 2017

(65) Prior Publication Data

US 2018/0216383 A1 Aug. 2, 2018

(30) Foreign Application Priority Data

Jul. 29, 2015 (NZ) ..... 710573

(51) Int. Cl.
*E05F 1/08* (2006.01)
*E05F 1/16* (2006.01)
(Continued)

(52) U.S. Cl.
CPC ..... *E05F 1/16* (2013.01); *E05F 3/227* (2013.01); *E05F 5/003* (2013.01); *E05F 5/027* (2013.01);
(Continued)

(58) Field of Classification Search
CPC ..... E05F 5/003; E05F 5/05; E05F 1/08; E05F 1/1091; E05F 1/16; E05F 3/00; E05F 3/02; E05F 3/04; E05F 3/18; E05F 3/227; E05F 3/22; E05F 3/10; E05F 3/108; E05F 3/224; E05F 5/02; E05Y 2800/24; E05Y 2800/21; E05Y 2201/64; E05Y 2201/644; E05Y 2201/264; E05Y 2201/41; E05Y 2201/412; E05Y 2201/47; E05Y 2201/21;
(Continued)

(56) References Cited

U.S. PATENT DOCUMENTS 7,624,476 B1 1/2009 Lin
8,235,478 B2 * 8/2012 Zimmer ..... A47B 88/467 312/319.1
(Continued)

FOREIGN PATENT DOCUMENTS

AU 2009256605 12/2009
AU 2010200253 8/2011
(Continued)

*Primary Examiner* — Chuck Y Mah
(74) *Attorney, Agent, or Firm* — Sheridan Ross P.C.

(57) ABSTRACT

A closure mechanism is described, the closure mechanism comprising: a base; a carriage movable along the base; a catching mechanism movable along the carriage; a first resilient mechanism connecting the base and the catching mechanism; and a second resilient mechanism connecting the carriage and the catching mechanism.

18 Claims, 45 Drawing Sheets

(51) Int. Cl.
*E05F 5/02* (2006.01)
*E05F 3/22* (2006.01)
*E05F 5/00* (2017.01)

(52) U.S. Cl.
CPC ... *E05Y 2201/492* (2013.01); *E05Y 2900/132* (2013.01)

(58) Field of Classification Search
CPC ..... E05Y 2201/488; E05Y 2900/132; E05Y 2900/142; E05Y 2900/14; E05Y 2201/232; E05Y 2201/426; E05Y 2201/638; E05Y 2201/688; E05Y 2800/11; Y10T 16/27; Y10T 16/56; Y10T 16/61; Y10T 16/593; Y10T 16/276; Y10T 16/281; Y10T 16/379; E05D 15/00; E05D 15/06; E05D 15/12; A47B 88/047; A47B 88/12; A47B 88/14; A47B 2210/0091
See application file for complete search history.

(56) References Cited

U.S. PATENT DOCUMENTS 8,745,821 B2 * 6/2014 Chang ..... E05F 5/003 16/49
8,746,422 B2 * 6/2014 Zimmer ..... E05F 1/16 188/265
8,793,839 B2 * 8/2014 Iwaki ..... E05F 1/16 16/49
8,931,138 B2 * 1/2015 Shimizu ..... E05F 1/16 16/49
9,380,873 B2 * 7/2016 Zimmer ..... A47B 88/463
9,605,461 B2 * 3/2017 Zimmer ..... E05D 15/0669
9,657,506 B2 * 5/2017 Bantle ..... E05F 1/16
9,945,167 B2 * 4/2018 Svara ..... E05F 5/003
2006/0016279 A1 * 1/2006 Sato ..... E05F 1/16 74/89.17
2007/0114896 A1 * 5/2007 Orita ..... E05F 1/16 312/334.14
2010/0031468 A1 * 2/2010 Tomiji ..... E05F 5/027 16/52
2010/0071154 A1 * 3/2010 Bortoluzzi ..... E05F 1/16 16/85
2011/0203183 A1 * 8/2011 Iwaki ..... E05F 1/16 49/358
2013/0091665 A1 * 4/2013 Tsai ..... E05F 3/18 16/49
2013/0122157 A1 * 5/2013 Dogan ..... B65D 85/8043 426/115
2013/0182978 A1 * 7/2013 Huang ..... E05F 5/003 384/21
2014/0026357 A1 * 1/2014 Zimmer ..... E05F 1/16 16/72
2014/0109343 A1 4/2014 Chang et al.
2016/0333622 A1 * 11/2016 Glogowski ..... E05F 5/003
2016/0340955 A1 * 11/2016 Zimmer ..... E05F 5/003

FOREIGN PATENT DOCUMENTS

AU 2011101339 11/2011
AU 2012261676 7/2013
DE 102013114309 A1 * 6/2015 ..... E05F 5/003
EP 2546444 A2 1/2013
JP 2008163704 A * 7/2008
JP 2008308968 A * 12/2008
NZ 600972 11/2013
NZ 609149 9/2014
NZ 612937 1/2015
NZ 618759 2/2015
NZ 619664 7/2015
NZ 622569 9/2015
WO WO-2006011294 A1 * 2/2006 ..... E05F 1/16
WO 2010043334 A1 4/2010
WO 2011095247 A1 4/2011

* cited by examiner

CLOSURE MECHANISM

CROSS REFERENCE TO RELATED APPLICATIONS

This application is a national stage application under 35 U.S.C. 371 and claims the benefit of PCT Application No. PCT/NZ2016/050120 having an international filing date of Jul. 29, 2016, which designated the United States, which PCT application claimed the benefit of New Zealand Patent Application No. 710573 filed Jul. 29, 2015, the disclosures of each of which are incorporated herein by reference.

The present invention relates to a closure mechanism and more particularly to a closure mechanism for positioning a sliding object including a door, panel or window.

BACKGROUND

Devices, systems and mechanisms for the closing of sliding doors are known. Various systems for closing doors are available including electric, magnetic and mechanical door closing systems. Known mechanical sliding door closing devices suffer from a variety of drawbacks, including requiring a large force to open the sliding door and the closure device so that the corresponding force needed to close the door can be provided by the closure device. This is particularly the case with heavy doors as a large force is required for a mechanical closure device to auto close the door, therefore a large force is required to open the door and to prime the closure device.

In this specification sliding object is to be understood to cover a sliding door, sliding panel, sliding window, sliding drawer or any other object that slides from a first position to a second position following a guide path, usually on or hung from a track. The sliding object may slide within a frame such as a door frame, a panel frame, a window frame or a drawer frame. While described as a closure device it is to be understood that closure refers to a position.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of the listed components which the use directly references, and possibly also of other non-specified components or elements.

It would be desirable to be able to prime a closure device when opening a sliding object, with less force than is able to be provided by the closure device when closing the sliding object.

Thus there is a need for a closure mechanism that is able to be opened with less force than the closing force provided by the mechanism or at least provides the public or industry with a useful choice.

SUMMARY OF THE INVENTION

In one embodiment the present invention consists in a closure mechanism comprising:

- a base;
- a carriage movable along the base;
- a catching mechanism movable along the carriage;
- a first resilient mechanism connecting the base and the catching mechanism; and
- a second resilient mechanism connecting the carriage and the catching mechanism.

Preferably the closure mechanism further comprising a linking mechanism connected to the catching mechanism and wherein the first resilient mechanism connects to the catching mechanism via the linking member.

Preferably the closure mechanism further comprising a latching mechanism connectable to the linking member and wherein the first resilient mechanism connects to the linking member via the latching mechanism.

Preferably the closure mechanism further comprising a damping mechanism for damping movement of the catching mechanism in at least one direction along the base.

Preferably the damping mechanism has a fixed end and a free end, the free end of the damping mechanism being connected to the catching mechanism.

Preferably the first resilient mechanism is at least one spring.

Preferably wherein the at least one spring is at least two springs.

Preferably the second resilient mechanism is at least one spring.

Preferably the at least one spring is at least two springs.

Preferably the closure mechanism is operable to position a positionable object.

Preferably the closure mechanism is operable to close a closable object within a body and wherein the closure catching mechanism cooperates with a catch trigger to close the closable object.

Preferably the closure mechanism is secured to the closable object and the catch trigger is secured to the body.

Preferably wherein the catch trigger is secured to the closable object and the closure mechanism is secured to the body.

Preferably the closable object is selected from the group consisting of a door, a window, a partition, a gate and a drawer.

Preferably wherein the body comprises a frame.

Preferably the closure mechanism further including at least one further resilient mechanism connectable to the catching mechanism.

Preferably the closure mechanism further including a resilient force adjusting mechanism for simultaneously adjusting the tension of all the resilient force mechanisms.

Preferably the resilient force adjusting mechanism includes:

- a driven gear associated with each resilient force mechanism configured to adjust the tension of the associated resilient force mechanism; and
- at least one drive gear engageable with the driven gears of the resilient force mechanisms, the at least one drive gear operable to simultaneously adjust the tension of all the resilient force mechanisms.

Preferably each at least one drive gear is movable from a first position in which it is engaged with the driven gears to a second position in which it is disengaged from the driven gears.

Preferably the drive gear is biased towards the disengaged position.

In a further embodiment the present invention consists in a closure mechanism comprising:

- an elongated member;
- a catch slidable along the elongated member; and
- a force providing mechanism operable to provide a force to the catch as the catch slides along the elongated member, wherein the maximum force provided by the force providing mechanism in a first direction is greater than the maximum force provided by the force providing mechanism in the second opposite direction.

Preferably the force providing mechanism includes at least two resilient mechanisms and wherein in a first direction all of the at least two resilient mechanisms operate together to provide a force and in the second direction each of the at least two resilient mechanisms operate separately, each resilient mechanism providing force for only part of the slide in the second direction.

Preferably the closure mechanism further comprising a damper operable to dampen the force applied to the catch in the first direction.

Preferably the closure mechanism is operable to position a positionable object.

Preferably the closure mechanism further including a resilient force adjusting mechanism for simultaneously adjusting the tension of all the resilient force mechanisms.

Preferably the resilient force adjusting mechanism includes:

a driven gear associated with each resilient force mechanism configured to adjust the tension of the associated resilient force mechanism; and at least one drive gear engageable with the driven gears of the resilient force mechanisms, the at least one drive gear operable to simultaneously adjust the tension of all the resilient force mechanisms.

Preferably each at least one drive gear is movable from a first position in which it is engaged with the driven gears to a second position in which it is disengaged from the driven gears.

Preferably the drive gear is biased towards the disengaged position.

In a further embodiment the present invention consists in a closing device for a panel comprising:

a base; the base having:

first and second ends; and a guide path, the guide path extending at least partially from the first end to the second end of the base;

a carriage, wherein the carriage is movable along the first guide path, the carriage having;

first and second ends; and a carriage guide path, the carriage guide path extending at least partially from the first end to the second end of the carriage;

a catching mechanism, wherein the catching mechanism is movable along the carriage guide path;

a connecting link having first and second ends, wherein the catching mechanism is connected to the connecting link at the second end;

a first resilient mechanism;

a linkage catching mechanism connectable with the first end of the connecting link, the first resilient mechanism connecting to the connecting link via the linkage catching mechanism;

a second resilient mechanism connecting the first end of the carriage and the catching mechanism; and a damping mechanism, for damping movement of the catching mechanism as it moves towards the first end of the base.

Preferably closing device for a panel further including at least one third resilient mechanism connectable to the catching mechanism.

Preferably the damping mechanism has a fixed end and a free end, the free end of the damping mechanism being connected to the linkage catching mechanism.

Preferably the panel is a door.

Preferably the panel is a window.

Preferably the panel is mounted within a frame, a catch trigger is attached to the frame, and the closing device is attached to the panel.

Preferably the panel is mounted within a frame, a catch trigger is attached to the panel, and the closing device is attached to the frame.

Preferably the closing device is operable to position the panel.

Preferably the closing device for a panel further including a resilient force adjusting mechanism for simultaneously adjusting the tension of all the resilient force mechanisms.

Preferably the resilient force adjusting mechanism includes:

a driven gear associated with each resilient force mechanism configured to adjust the tension of the associated resilient force mechanism; and at least one drive gear engageable with the driven gears of the resilient force mechanisms, the at least one drive gear operable to simultaneously adjust the tension of all the resilient force mechanisms.

Preferably each at least one drive gear is movable from a first position in which it is engaged with the driven gears to a second position in which it is disengaged from the driven gears.

Preferably the drive gear is biased towards the disengaged position.

In a further embodiment the present invention consists in a configurable control mechanism for a slidable object comprising:

an elongated base, the elongated base housing subassemblies, the elongated base having first and second ends; and at least two elongated subassemblies having first and second ends, the elongated subassemblies installable in the base, the first and second ends of the elongated subassemblies substantially aligned with the first and second ends of the elongated base, wherein the at least two subassemblies are selected from the group comprising, a resilient force mechanism and a damping mechanism, each of the subassemblies having:

a path extending at least partially from the first end to the second end of the subassembly; and a carriage, wherein the carriage is movable along the path, the carriage having at least one connecting mechanism, each at least one connecting mechanism operable to connect one subassembly to another subassembly or to a catching mechanism.

Preferably the group from which the subassemblies are selected further comprises a mechanical switching mechanism operable to control another device, an electrical switching mechanism, a locking mechanism, a motorised controlling mechanism and a multipurpose subassembly.

Preferably the slidable object is a panel.

Preferably the panel is a window.

Preferably the panel is a door.

Preferably the slidable object is mounted within a frame, a catch trigger is attached to the frame, and the configurable control mechanism is attached to the panel.

Preferably the panel is mounted within a frame, a catch trigger is attached to the panel, and the configurable control mechanism is attached to the frame.

Preferably the at least two elongated subassemblies is at least three subassemblies and at least two of the at least three subassemblies are resilient force mechanisms and wherein the maximum force provided in a first direction is greater than the maximum force provided in the second opposite direction Preferably the at least two elongated subassemblies is at least three subassemblies and at least two of the at least three subassemblies are resilient force mechanisms and wherein in a first direction of travel all of the at least two resilient force mechanisms operate together to provide a force and in the second direction each of the at least two resilient force mechanisms operate separately, each resilient force mechanism providing force for only part of the slide in the second direction.

Preferably configurable control mechanism for a slidable further including a resilient force adjusting mechanism for simultaneously adjusting the tension of all the resilient force mechanisms.

Preferably the resilient force adjusting mechanism includes:

a driven gear associated with each resilient force mechanism configured to adjust the tension of the associated resilient force mechanism; and at least one drive gear engageable with the driven gears of the resilient force mechanisms, the at least one drive gear operable to simultaneously adjust the tension of all the resilient force mechanisms.

Preferably each at least one drive gear is movable from a first position in which it is engaged with the driven gears to a second position in which it is disengaged from the driven gears.

Preferably the drive gear is biased towards the disengaged position.

In a further embodiment the present invention consists in a kit set control mechanism for a slidable object comprising the elongated base and subassemblies of the previous embodiment.

In a further embodiment the present invention consists in a closure mechanism comprising:

an elongated base, the elongated base having:

first and second ends; and a guide path, the guide path extending at least partially from the first to the second ends of the base; and a first subassembly fixed in the guide path substantially at the first end, the first subassembly having:

first and second ends substantially in the same direction of the first and second ends of the base;

a carriage path extending at least partially from the first end to the second end of the first subassembly;

a carriage movable along the carriage path, the carriage having:

a linking mechanism, the linking mechanism operable to connect to a linking mechanism of another subassembly; and a resilient mechanism connecting the first end of the first subassembly and the carriage;

a second subassembly slidable along the guide path parallel to the first subassembly, and being slidable from the first to the second end of the guide path, the second subassembly having:

first and second ends substantially in the same direction of the first and second ends of the base;

a carriage path extending at least partially from the first end to the second end;

a carriage movable along the carriage path, the carriage having:

a linking mechanism operable to connect to the linking mechanism of another subassembly; and a catching mechanism;

a resilient mechanism connecting the first end of the second subassembly and the carriage;

Preferably the closure mechanism further comprising a damping subassembly for damping movement of the catching mechanism in at least one direction along the base.

Preferably wherein the damping mechanism has a fixed end and a free end, the free end of the damping mechanism being connected to the catching mechanism.

Preferably the resilient mechanisms of the subassemblies is at least one spring.

Preferably the at least one spring is at least two springs.

Preferably the closure mechanism is operable to position a positionable object.

Preferably the closure mechanism is operable to close a closable object within a body and wherein the closure mechanism catching mechanism cooperates with a catch trigger to close the closable object.

Preferably wherein the closure mechanism is secured to the closable object and the catch trigger is secured to the body.

Preferably the catch trigger is secured to the closable object and the closure mechanism is secured to the body.

Preferably the closable object is selected from the group consisting of a door, a window, a partition, a gate, a panel and a drawer.

Preferably the closure mechanism further including at least one further subassembly slidable along the guide path in parallel to other subassemblies, each at least one further subassembly being slidable from the first end of the guide path to a stop in the guide path associated with each at least one further subassembly, each at least one further subassembly having:

first and second ends substantially in the same direction of the first and second ends of the base;

a carriage path extending at least partially from the first end to the second end;

a carriage movable along the carriage path, the carriage having:

a first linking mechanism operable to connect to the linking mechanism of another subassembly; and a second linking mechanism operable to connect to the linking mechanism of another subassembly; and a resilient mechanism connecting the first end of each at least one further subassembly and the carriage.

Preferably the closure mechanism further including a resilient force adjusting mechanism for simultaneously adjusting the tension of all the resilient force mechanisms.

Preferably the resilient force adjusting mechanism includes:

a driven gear associated with each resilient force mechanism configured to adjust the tension of the associated resilient force mechanism; and at least one drive gear engageable with the driven gears of the resilient force mechanisms, the at least one drive gear operable to simultaneously adjust the tension of all the resilient force mechanisms.

Preferably each at least one drive gear is movable from a first position in which it is engaged with the driven gears to a second position in which it is disengaged from the driven gears.

Preferably the drive gear is biased towards the disengaged position.

In a further embodiment the present invention consists in an adjusting mechanism for a closure, the closure having at least two resilient force mechanisms wherein the resilient force adjusting mechanism includes:

a driven gear associated with each resilient force mechanism configured to adjust the tension of the associated resilient force mechanism; and at least one drive gear engageable with the driven gears of the resilient force mechanisms, the at least one drive gear operable to simultaneously adjust the tension of all the resilient force mechanisms.

Preferably each at least one drive gear is movable from a first position in which it is engaged with the driven gears to a second position in which it is disengaged from the driven gears.

Preferably the drive gear is biased towards the disengaged position.

In a further embodiment the present invention consists in a subassembly for a closure mechanism the closure mechanism having an elongated base, the subassembly having:

an elongated body having first and second ends;

a carriage path extending at least partially from the first end to the second end;

a carriage movable along the carriage path, the carriage having:

a first linking mechanism operable to connect to the linking mechanism of another subassembly; and a second linking mechanism operable to connect to the linking mechanism of another subassembly or to an object trigger; and a resilient mechanism connecting the first end of each at least one further subassembly and the carriage, wherein the subassembly is configured to operate with at least one other subassembly in the closure mechanism, the subassemblies configured in the closure mechanism base such that the maximum force provided by the subassemblies in a first direction is greater than the maximum force provided by the subassemblies in the second opposite direction

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 6A:
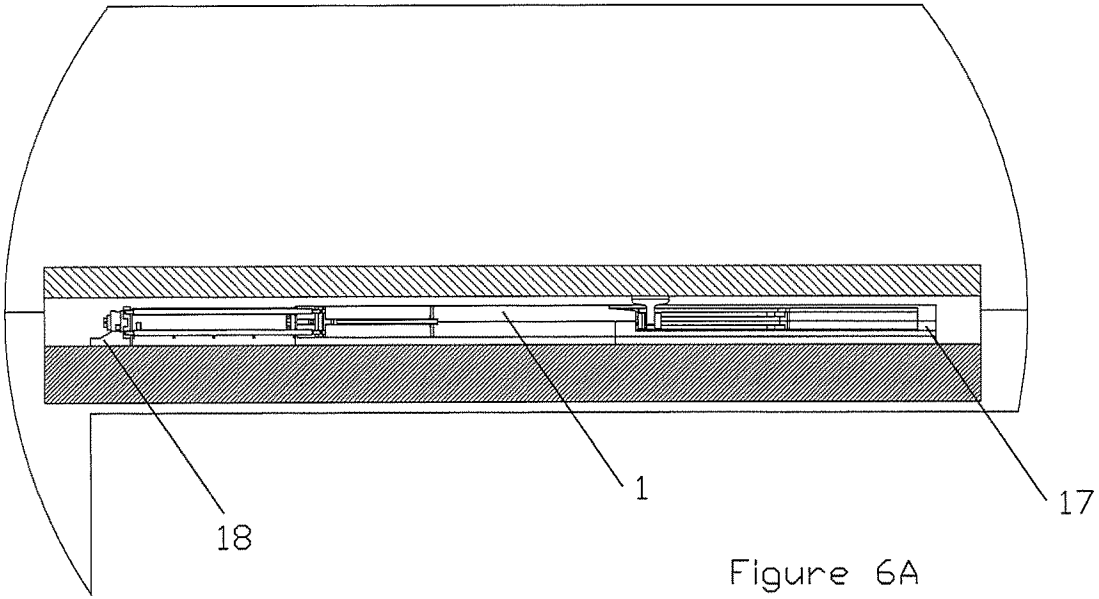
FIG. 6A is a front partial cross sectional view of part 'A' of the closure mechanism of FIG. 6 mounted on a door.
Figure 6:
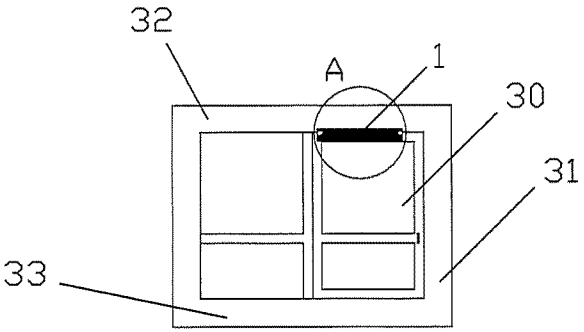
FIG. 6 is a view of a door and the closure mechanism mounted on a door.

Referring to FIGS. 6 and 6A the closure mechanism 1 is shown within a door 30, the door being slidably mounted within a frame 31. While the closure mechanism 1 is illustrated mounted in the top of the door 30, it is to be understood that the closure mechanism 1 could be mounted in the bottom of the door 30 or the closure mechanism 1 could be mounted in either the top 32 of the frame 31 or the bottom 33 of the frame 31.

Figure 1:
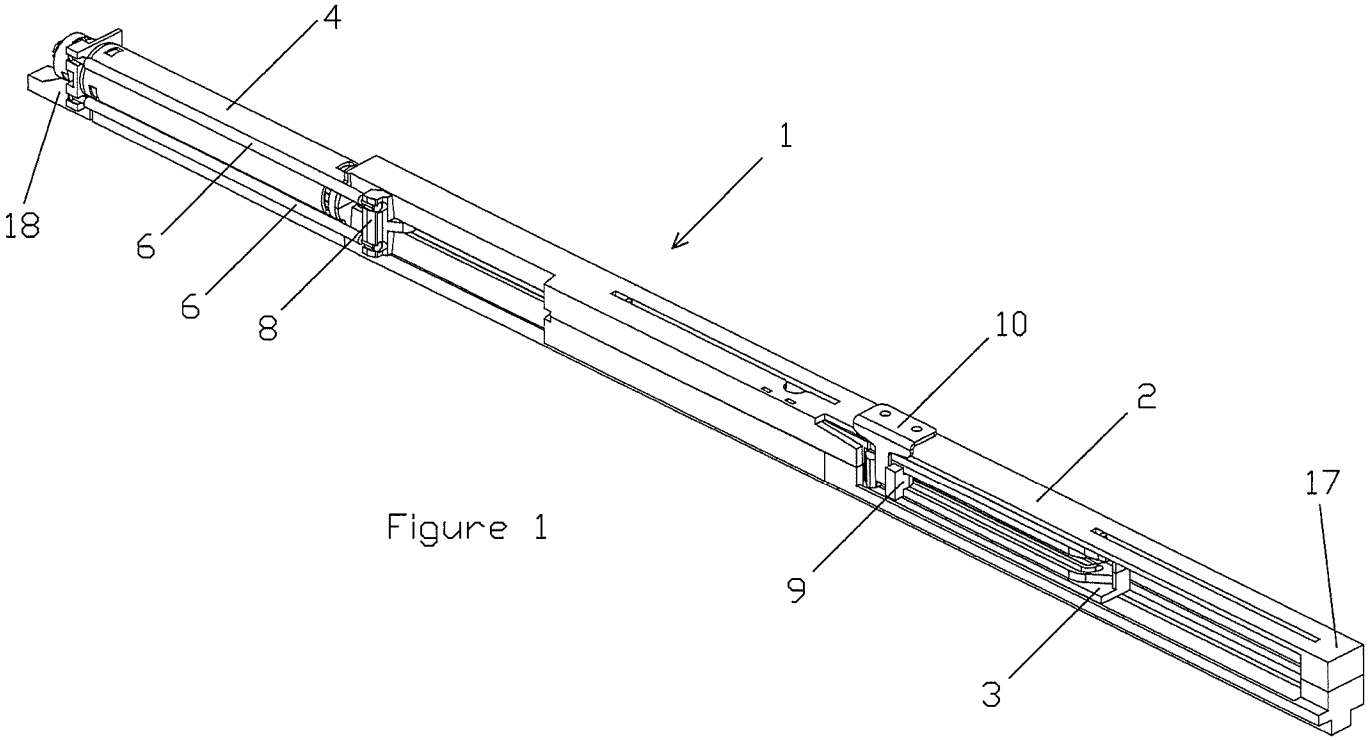
FIG. 1 is a view of the closure mechanism.
Figure 2:
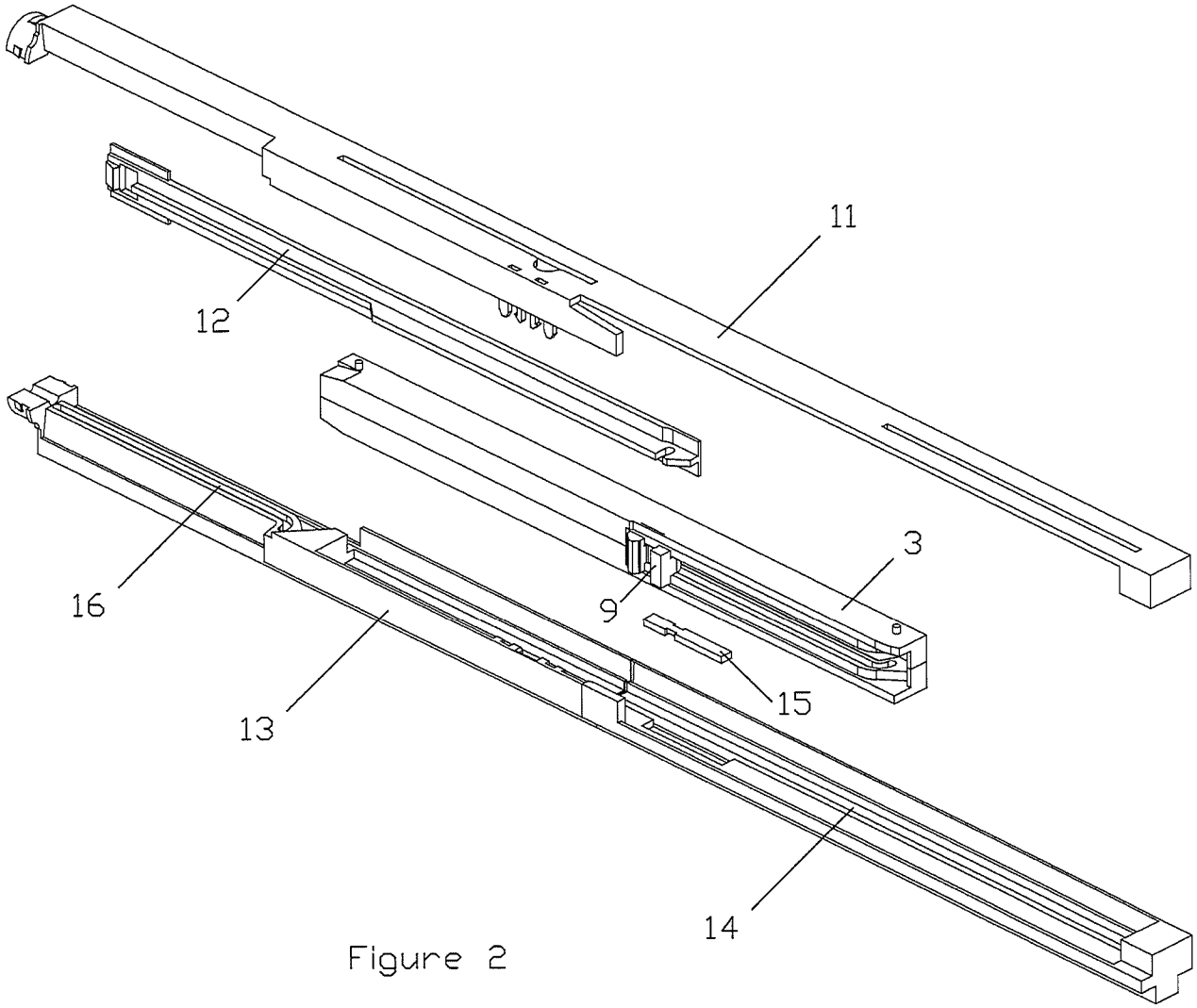
FIG. 2 is a partial assembly view of the closure mechanism.
Figure 3:
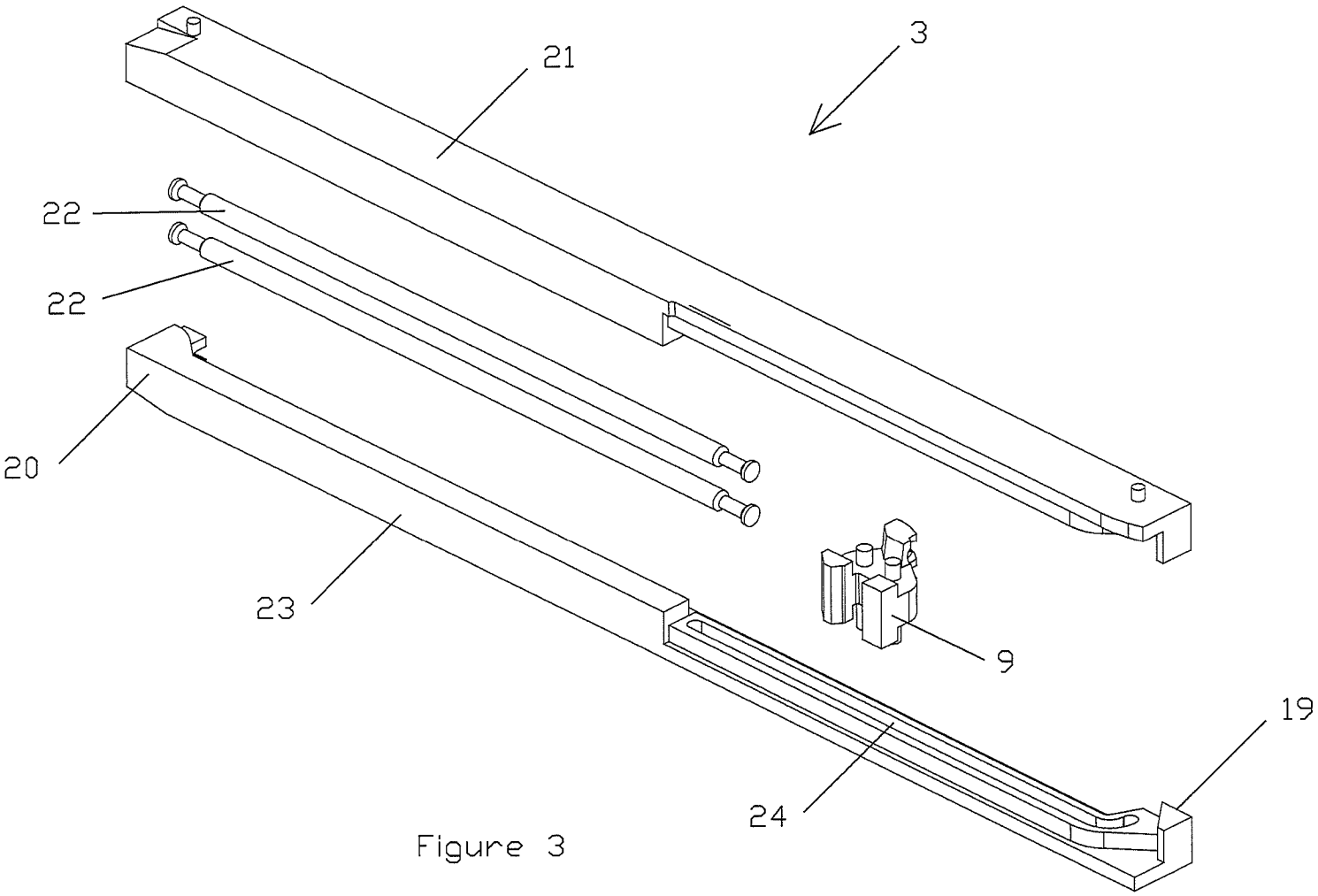
FIG. 3 is an assembly view of the carriage sub assembly of the closure mechanism.

Referring to FIGS. 1 to 3 the closure mechanism 1 of the present invention is illustrated. The closure mechanism 1 includes an elongated closure mechanism body 2. The closure mechanism body 2 consists of an upper closure mechanism body 11 and a lower closure mechanism body 13. The closure mechanism 1 has a first end 18 which in use is located in the direction that the slidable object moves to close and a second end 17 which in use is located in the direction in which the slidable object moves to open.

A carriage 3 is movable along the closure mechanism body 2 in a track or guide path 14. Slidable within the carriage 3 is a catching mechanism or catch 9. The catching mechanism 9 in use, catches a trigger 10. If the closure mechanism 1 is mounted in the slidable object, then the trigger 10 is mounted on the frame. However as discussed above the closure mechanism could be mounted on or in a frame and so the trigger 10 could be mounted on the slidable object.

A first resilient mechanism 6 connects the closure mechanism 1 at the closed end 18 and at the other end the first resilient mechanism 6 connects to the linkage catching mechanism 8. The first resilient mechanism 6 is operable to provide a closing force. The linkage catching mechanism 8 is movable along a track or guide path 16 in the closure mechanism body 2 and is connectable to a linkage 12.

A damping mechanism 4 having a damping mechanism shaft 41 is situated at the first end 18 of the closure mechanism 1 and is in one embodiment adjustable depending on the load. The damping mechanism shaft 41 is connected to the linkage catching mechanism 8 and is operable to dampen the movable object as the object moves to a closed position.

A carriage 3 is slidable on a track or guide path 14 in the closure mechanism body 2. The carriage 3 has an upper body 21 and a lower body 23. The carriage 3 has a first end 20 nearest the closed end 18 of the closure mechanism 1 and a second end 19 nearest the open end 17 of the closure mechanism 1. The carriage 3 includes a carriage catch track or guide path 24 along which slides the catching mechanism 9. In use the catching mechanism 9 catches the trigger 10. The catching mechanism 9 is connected to the linkage 12. A second resilient mechanism 22 connects between the catching mechanism 9 and first end 20 of the carriage 3. The second resilient mechanism 22 is operable to provide a closing force. The linkage 12 connects the linkage catch 8 and the catching mechanism 9.

Figure 4:
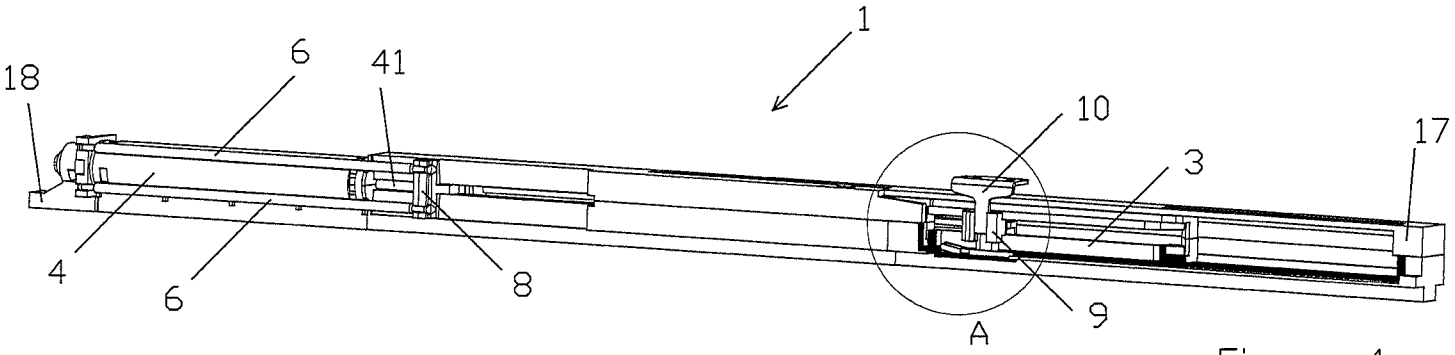
FIG. 4 is a view of the closure mechanism in position showing the latch engaged.
Figure 4A:
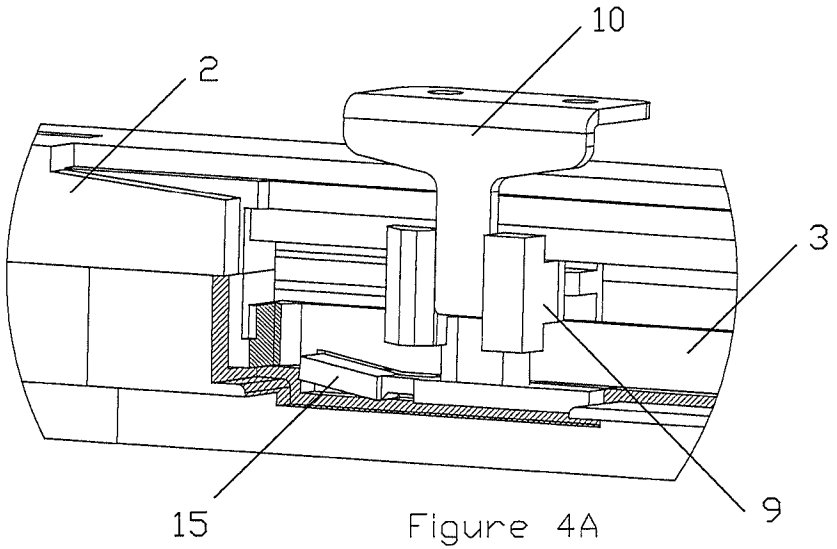
FIG. 4A is a close up view of part 'A' of the closure mechanism of FIG. 4 in position showing the latch engaged.
Figure 5:
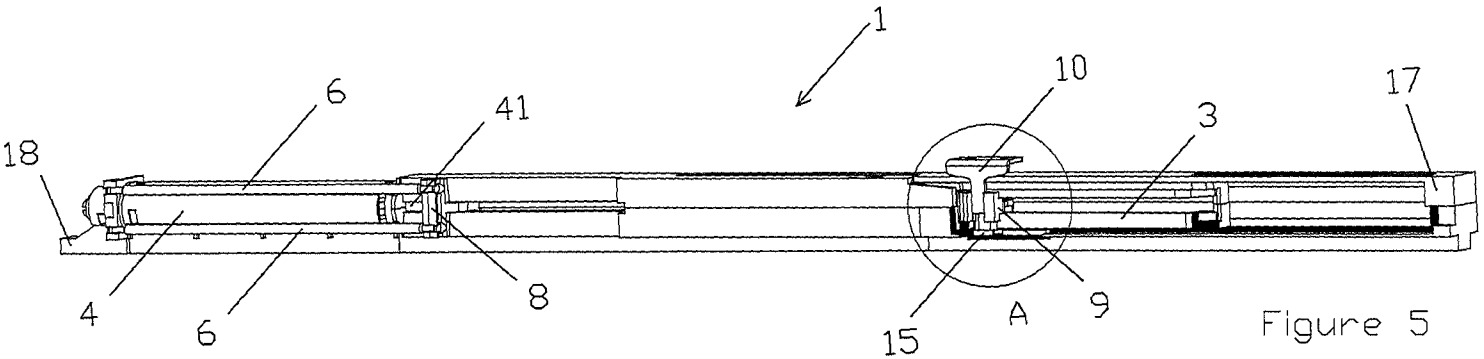
FIG. 5 is a view of the closure mechanism in position showing the latch disengaged.
Figure 5A:
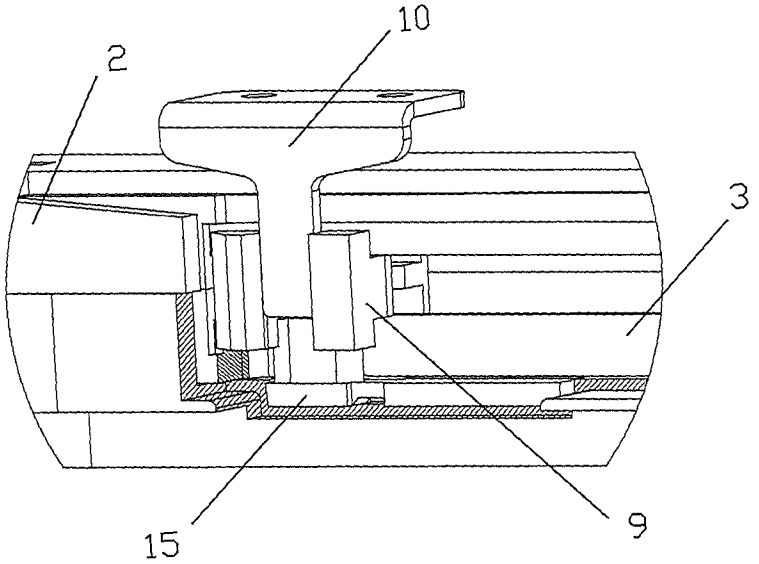
FIG. 5A is a close up view of part 'A' of the closure mechanism of FIG. 5 in position showing the latch disengaged.

Referring to FIGS. 4, 4A, 5 and 5A a latch 15 assists in securing the carriage 3 in position at the furthest extent it can travel on the track or guide path 14 towards the first end 18. As can be seen in FIG. 4A when the carriage is at the further extent it can travel in track 14 towards the first end 18 the latch 15 applies a force to the carriage 3 to assist the carriage 3 to stay in position. Referring to FIG. 5A as the catching mechanism 9 reaches the furthest extent it can travel in track 24 towards the first end 18 the latch 15 is pushed down by the catching mechanism 9 allowing the carriage 3 to move in track 14.

The resilient mechanisms 6 and 22 may be a spring or any other suitable resilient mechanism such as a rubber spring. In one embodiment the resilient mechanisms 6 and 22 each consist of a pair of springs.

The closure mechanism body 2 and other components may be made of plastic or metal or any other suitable material. Preferably the tracks 14, 16 and 24 offer low resistance to the sliding components of the closure mechanism 1.

Figure 7:
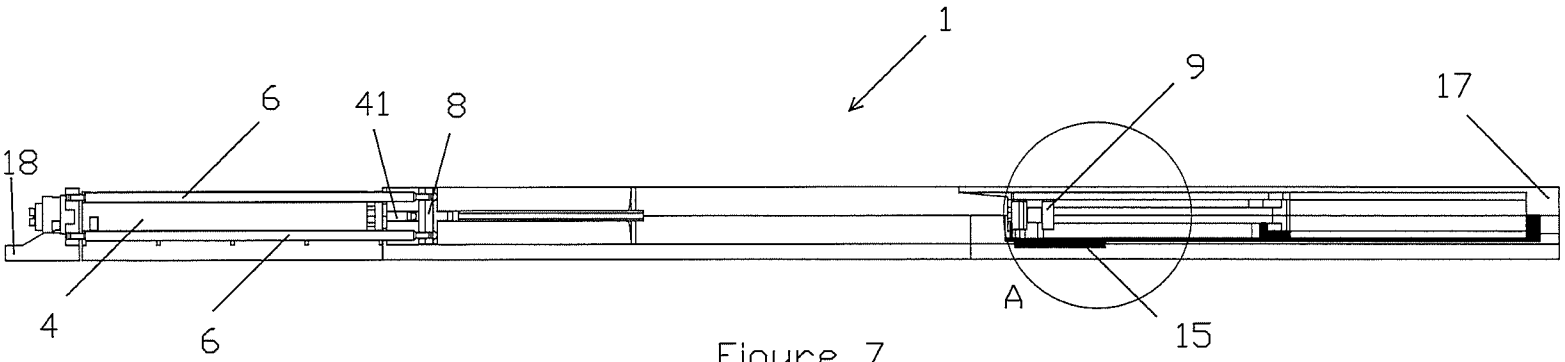
FIG. 7 is a front view of the closure mechanism, illustrating the mechanism in a fully closed position.
Figure 7A:
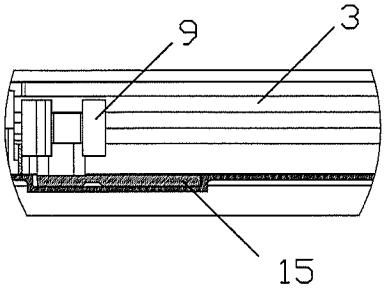
FIG. 7A is a close up view of part 'A' of the closure mechanism of FIG. 7, illustrating the mechanism in a fully closed position.
Figure 12:
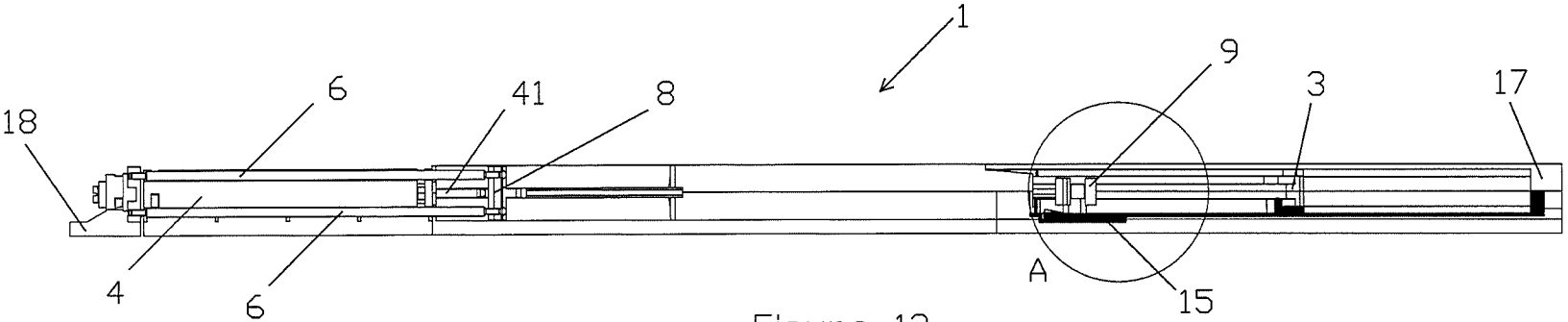
FIG. 12 is a front view of the closure mechanism, illustrating the mechanism in a third partially closed position.
Figure 13:
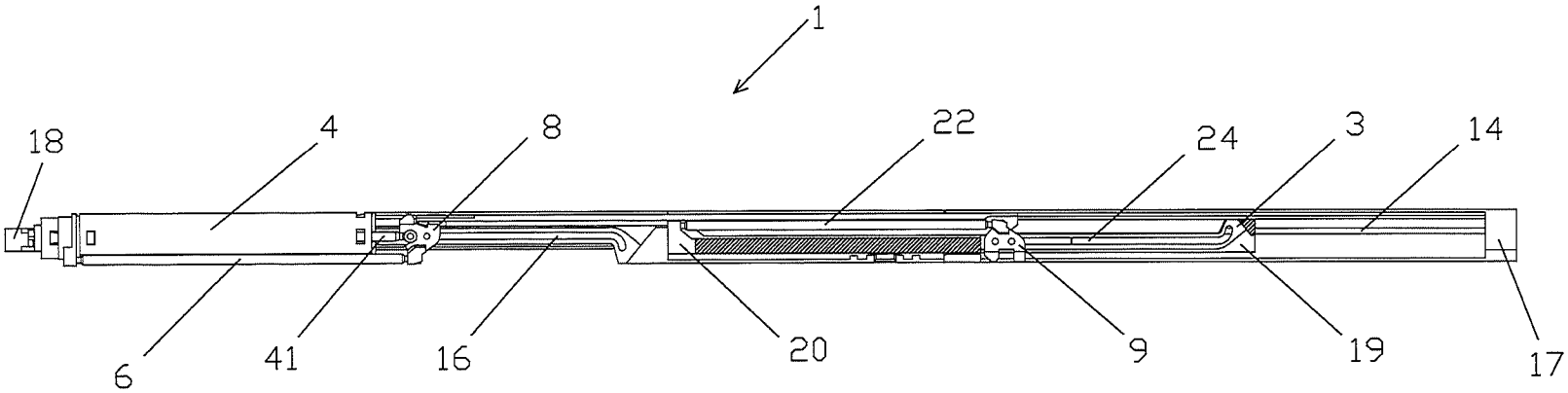
FIG. 13 is a top view of the closure mechanism, illustrating the mechanism in a fully closed position.

Referring to FIGS. 7 to 17 the operation of the closure mechanism 1 will now be described. Referring particularly to FIGS. 7, 7A and 13 starting from the closed position where the catching mechanism 9 is nearest the first end 20 of the carriage track or guide path 14 and the carriage 3 is nearest the closed end 18 of the closure mechanism 1 in track or guide path 14. Both resilient mechanisms 6 and 22 are in a relaxed position. The damping mechanism shaft 41 is substantially within the damping mechanism 4 body. The linkage catch 8 is connected to the linkage 12. The latch 15 is pushed down by the catching mechanism 9 allowing the carriage 3 to move in track 14.

The resilient mechanisms 6 and 22 are described as in a relaxed position when they are applying little force on the catching mechanism 9 and in a primed or extended position when they are able to apply force to the catching mechanism 9.

In use when a moveable object is opened the trigger 10 is held by the catching mechanism 9, and as the trigger 10 moves towards the open end 17 of the closure mechanism 1, the first resilient mechanism 6 is extended to a stretched/primed position and the damping mechanism shaft 41 is extended.

Figure 8:
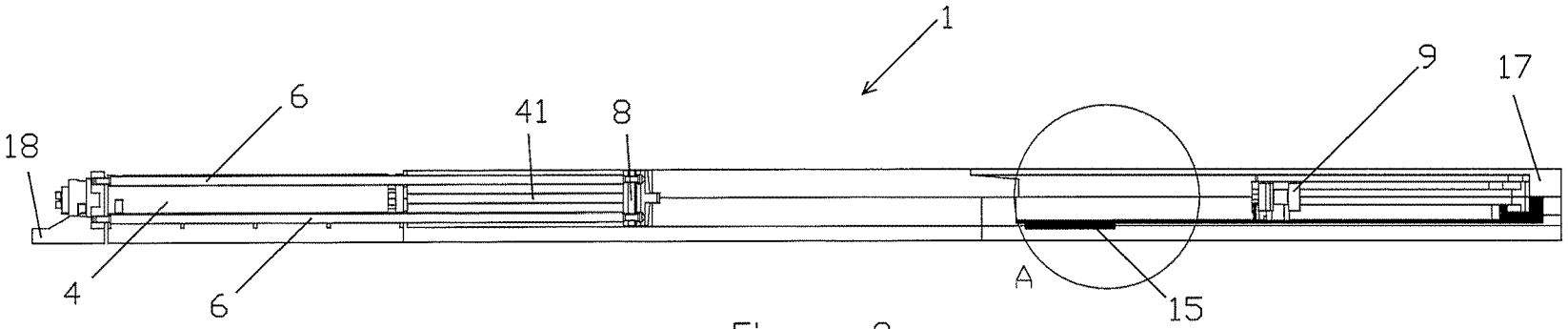
FIG. 8 is a front view of the closure mechanism, illustrating the mechanism in a first partially open position.
Figure 8A:
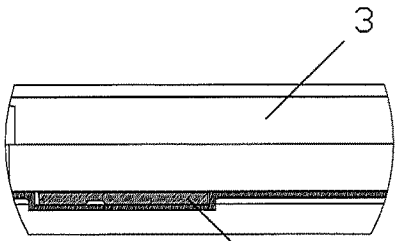
FIG. 8A is a close up view of part 'A' of the closure mechanism of FIG. 8, illustrating the mechanism in a first partially open position.
Figure 14:
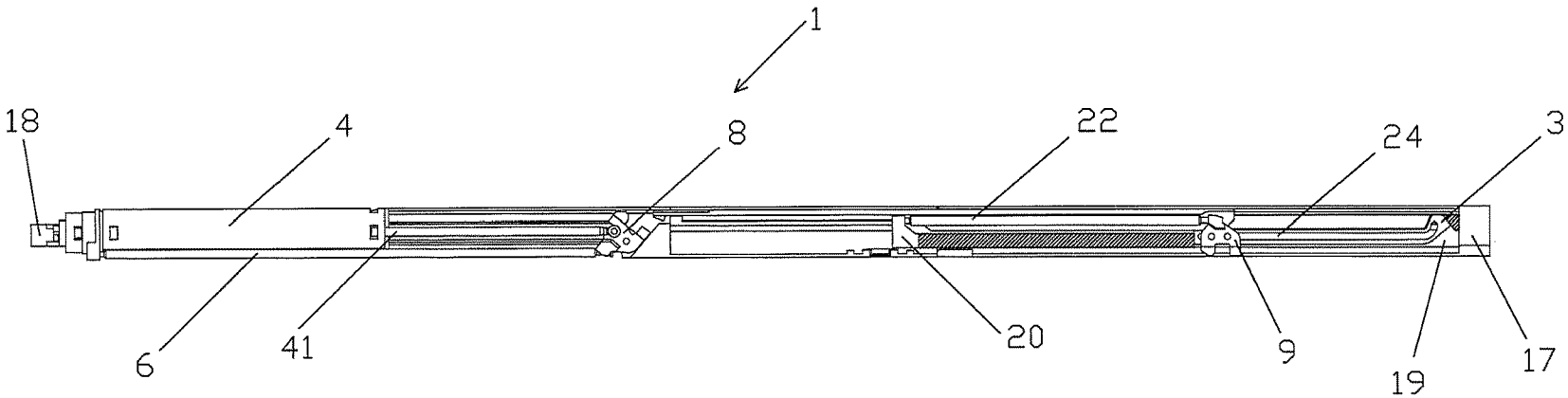
FIG. 14 is a top view of the closure mechanism, illustrating the mechanism in a first partially open position.

Referring to FIGS. 8, 8A and 14 the first resilient mechanism 6 and the damping mechanism shaft 41 are extended as the first resilient mechanism 6 and the damping mechanism shaft 41 are connected to the linkage catch 8 which is in turn connected to the catching mechanism 9 via the linkage 12. Thus the first resilient mechanism 6 and the damping mechanism shaft 41 are extended as the linkage catch 8 moves along the linkage catch track or guide path 16 towards the open end of the closure mechanism body 2.

The carriage 3 having been released from the sprung latch 15 also moves along the carriage track or guide path 14 to the end of the carriage track or guide path 14 nearest the open end 17 of the closure mechanism 1. At this stage the closure mechanism has only extended the first resilient mechanism 6, the second resilient mechanism 22 has not been extended at all. A force sufficient to extend the first resilient mechanism 6 and the damping mechanism shaft 41 is only required. As the second resilient mechanism 22 is not extended at the same time no force is acting on the second resilient mechanism 22.

As the trigger 10 moves further towards the open end 17 of the closure mechanism 1, the linkage catch 8 disengages from the linkage 12 and the catching mechanism 9 slides along towards the second end of the closure mechanism body in track or guide path 24. The first resilient mechanism 6 and the damping mechanism shaft 41 remain in an extended position held by the linkage catch 8.

Figure 9:
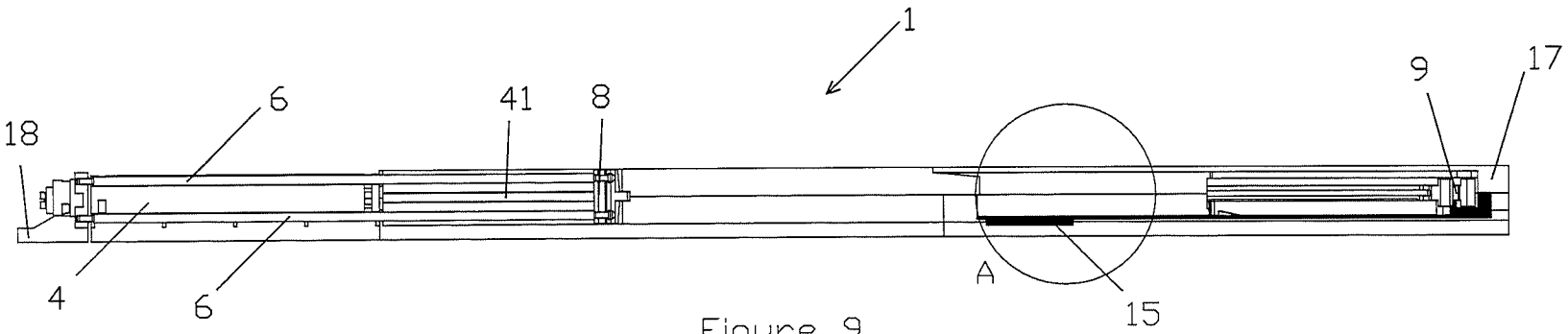
FIG. 9 is a front view of the closure mechanism, illustrating the mechanism in a fully open position.
Figure 9A:
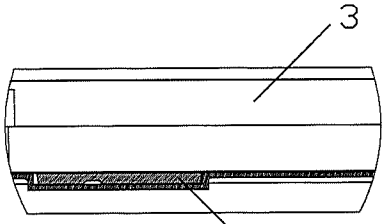
FIG. 9A is a close up view of part 'A' of the closure mechanism of FIG. 9, illustrating the mechanism in a fully open position.
Figure 15:
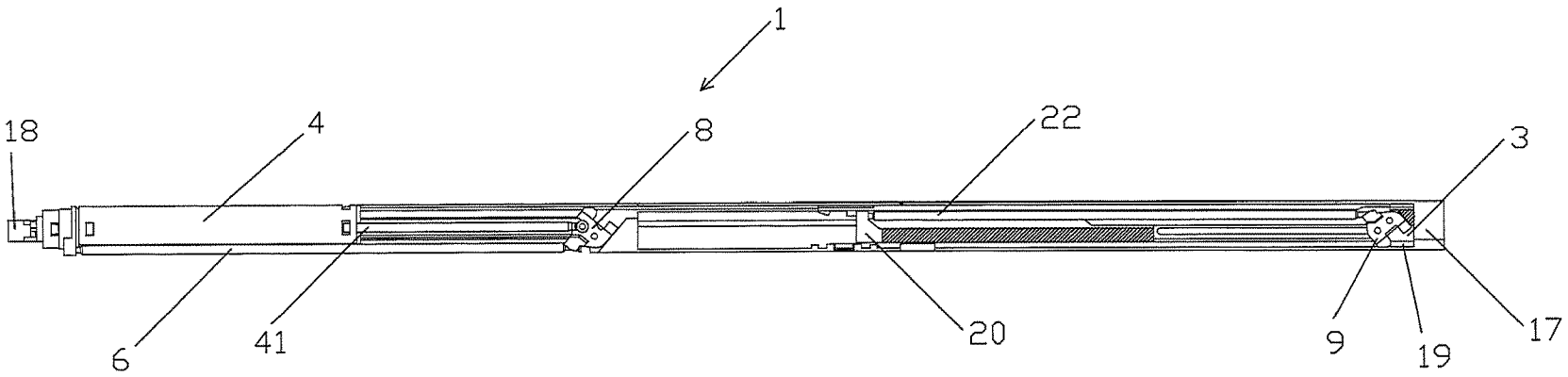
FIG. 15 is a top view of the closure mechanism, illustrating the mechanism in a fully open position.

Referring to FIGS. 9, 9A and 15 as the trigger 10 moves towards the open end 17 of the closure mechanism 1 the catching mechanism 9 moves along the carriage track or guide path 14 and extends the second resilient mechanism 22. As the trigger 10 moves further away from the closed position the catching mechanism 9 releases the trigger and the catching mechanism 9 holds the second resilient mechanism 22 in an extended position. As the first resilient mechanism 6 is not extended at this time no force is acting on the first resilient mechanism 6 while the second resilient mechanism 22 is extended, thus the full force available from closing has not been required to open/prime the closure mechanism 1.

Figure 10:
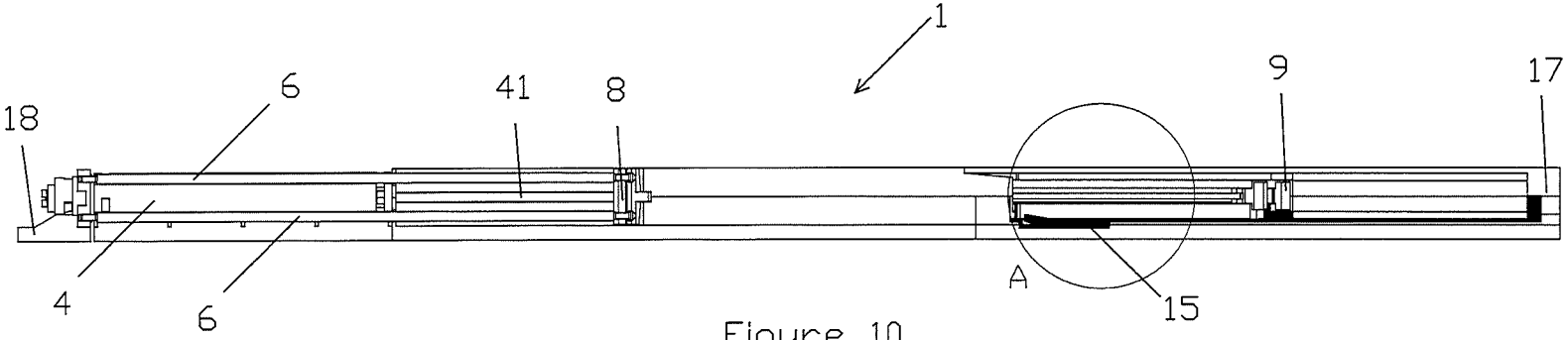
FIG. 10 is a front view of the closure mechanism, illustrating the mechanism in a first partially closed position.
Figure 10A:
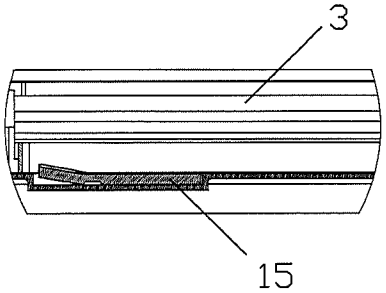
FIG. 10A is a close up view of part 'A' of the closure mechanism of FIG. 10, illustrating the mechanism in a first partially closed position.
Figure 11:
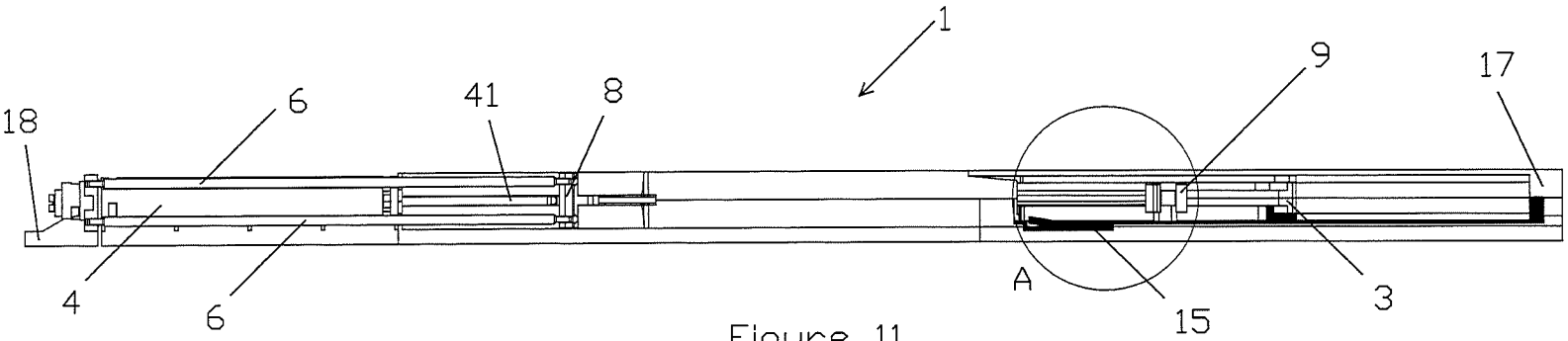
FIG. 11 is a front view of the closure mechanism, illustrating the mechanism in a second partially closed position.
Figure 11A:
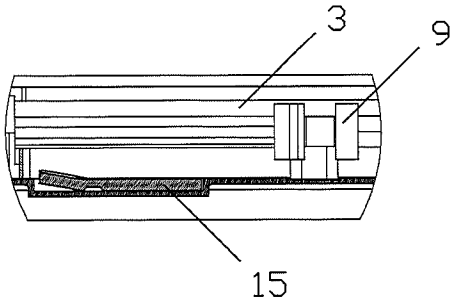
FIG. 11A is a close up view of part 'A' of the closure mechanism of FIG. 11, illustrating the mechanism in a second partially closed position.
Figure 16:
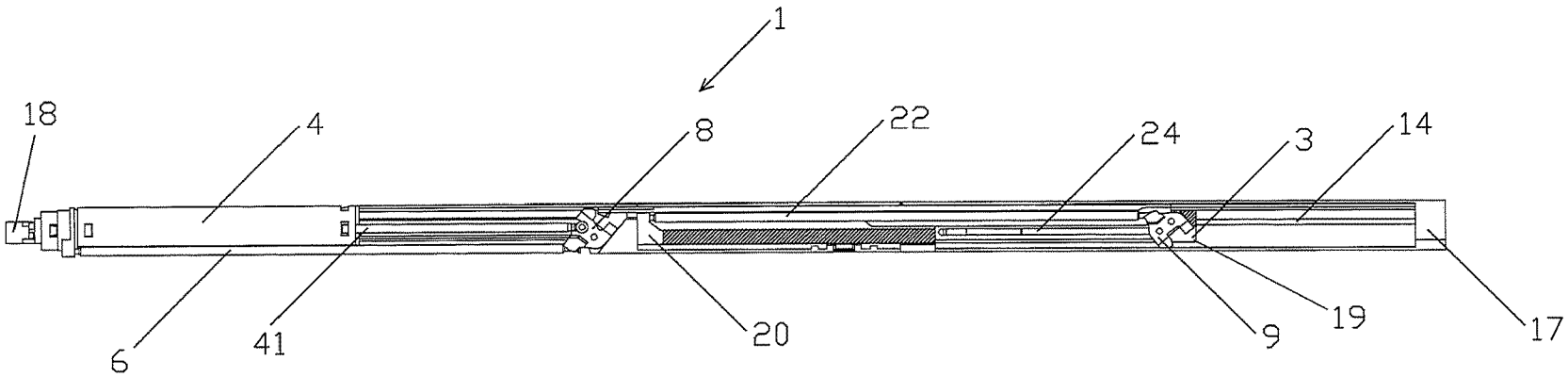
FIG. 16 is a top view of the closure mechanism, illustrating the mechanism in a first partially closed position.
Figure 17:
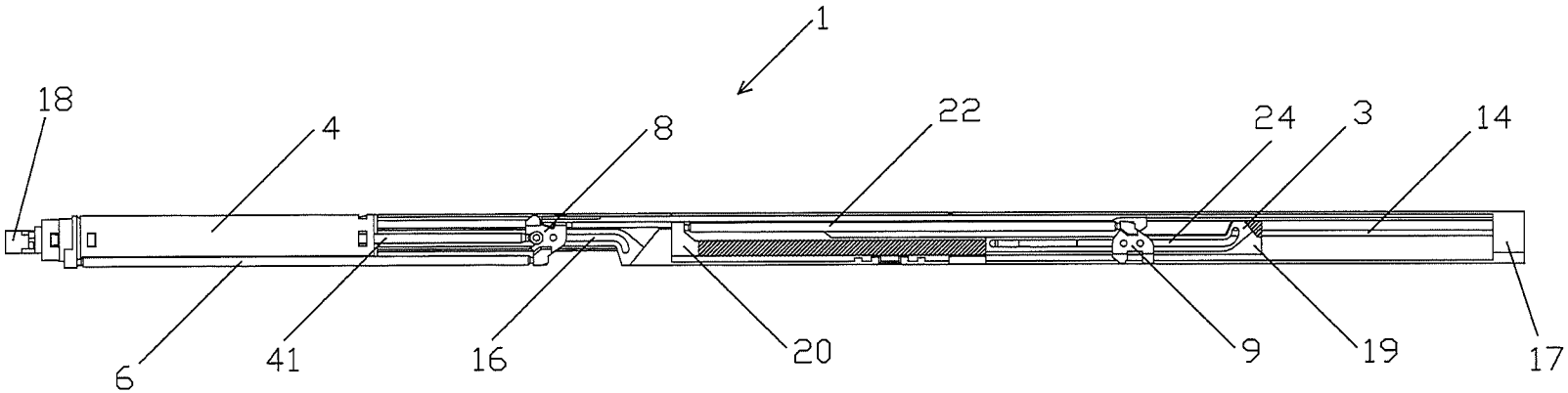
FIG. 17 is a top view of the closure mechanism, illustrating the mechanism in a second partially closed position.

From an open position seen in FIGS. 9, 9A and 15 as a panel in use is moved towards the closed end 18 of the closure mechanism 1 the trigger 10 connects with the catching mechanism 9. As seen in FIGS. 10, 10A and 16 the carriage 3 slides along the carriage track or guide path 14 until the linkage 12 connects with the linkage catch 8 and the latch 15 operates to hold the carriage 3 at the furthest extent of the carriages travel along track 14 in the direction of end 18.

Figure 12A:
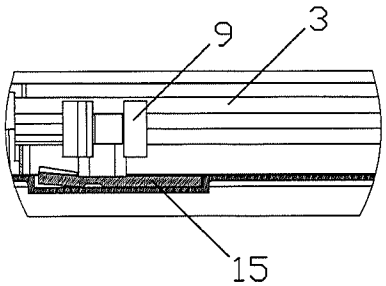
FIG. 12A is a close up view of part 'A' of the closure mechanism of FIG. 12, illustrating the mechanism in a third partially closed position.

At this stage the first resilient member 6 and the second resilient member 22 are still fully extended. Then as the linkage 12 connects with the linkage catch 8 the first resilient member 6 and the second resilient member 22 begin to simultaneously compress/close applying the force of both resilient mechanisms 6, 22 at the same time. The damping mechanism shaft 41 moves within the damping mechanism 4 and provides a damping force as the panel closes. This can be seen in FIGS. 11, 11A, 12, 12A and 17. As shown in FIGS. 12 and 12A the latch 15 is still operable to secure the carriage 3 in position until the catching mechanism 9 returns to the closed position seen in FIGS. 7, 7A and 13 and the latch 15 is pushed down by the catching mechanism 9 allowing the carriage 3 to move in track 14.

Figure 18:
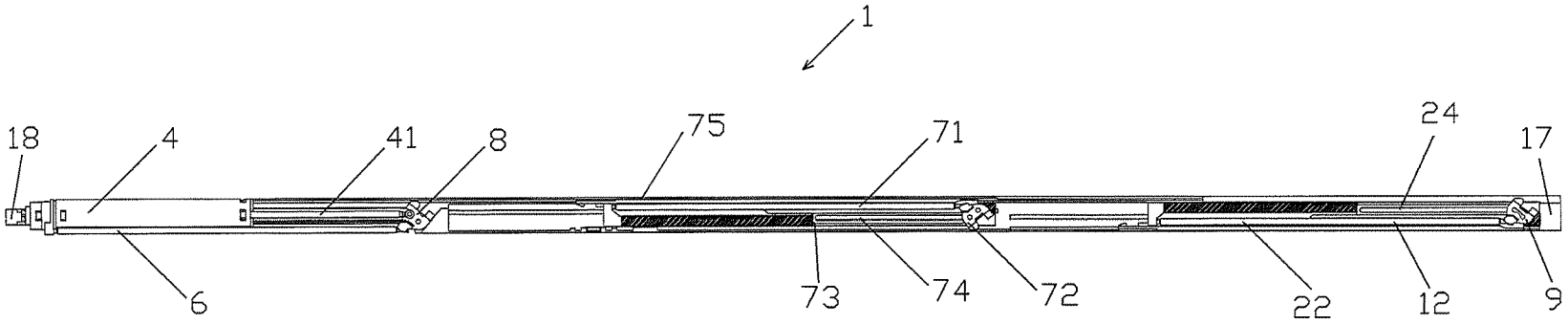
FIG. 18 is a top view of an alternative closure mechanism having three sets of resilient members in a fully open position.
Figure 19:
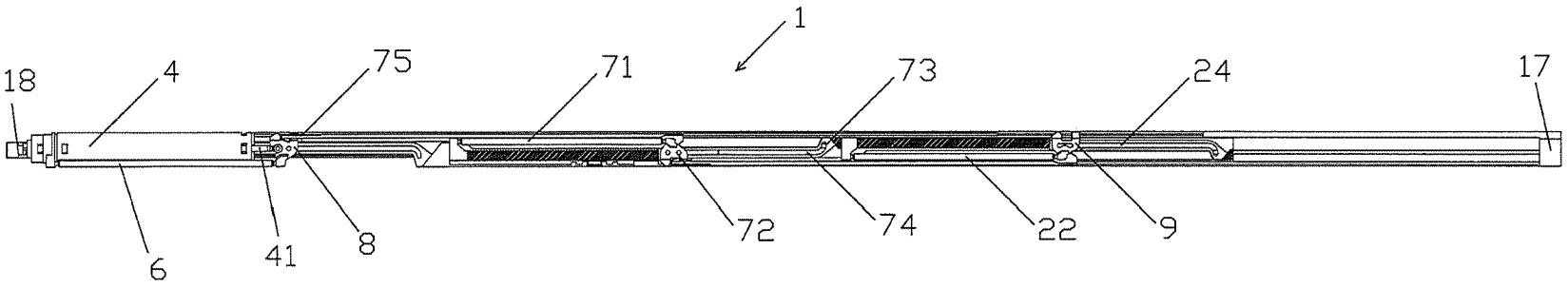
FIG. 19 is a top view of an alternative closure mechanism having three sets of resilient members in a fully closed position.
Figure 20:
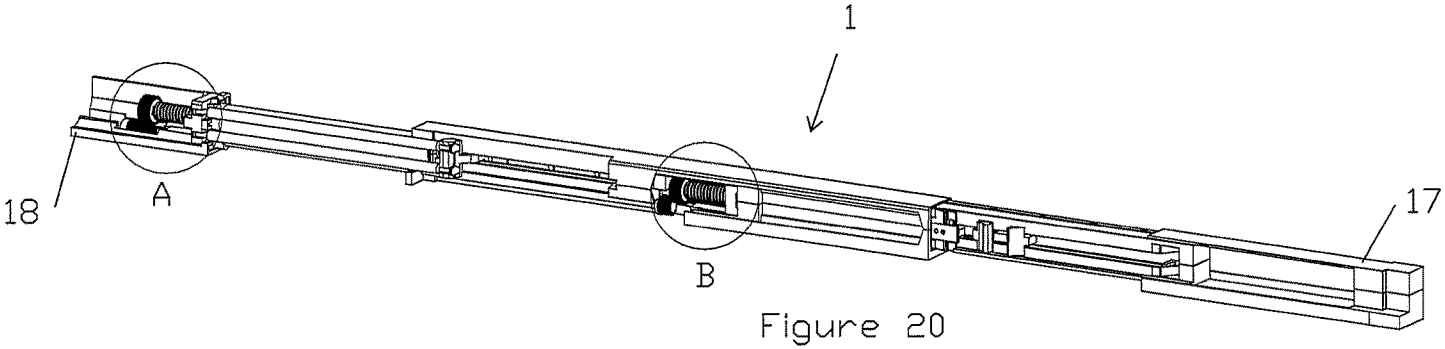
FIG. 20 is a view of an alternative embodiment of the closure mechanism having an adjustable resilient mechanism, illustrating the adjustment mechanism disengaged and adjusted to provide the least tension.
Figure 20B:
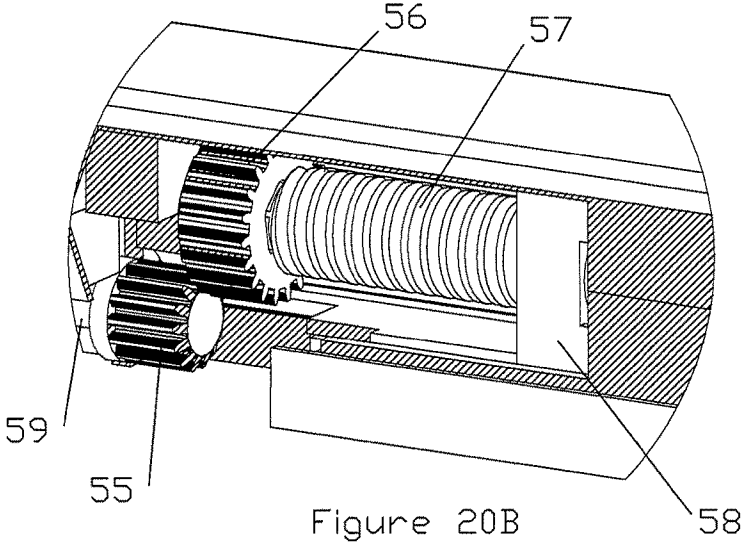
FIG. 20B is a close up view of part 'B' of the closure mechanism of FIG. 20, illustrating the adjustment mechanism disengaged and adjusted to provide the least tension.
Figure 20A:
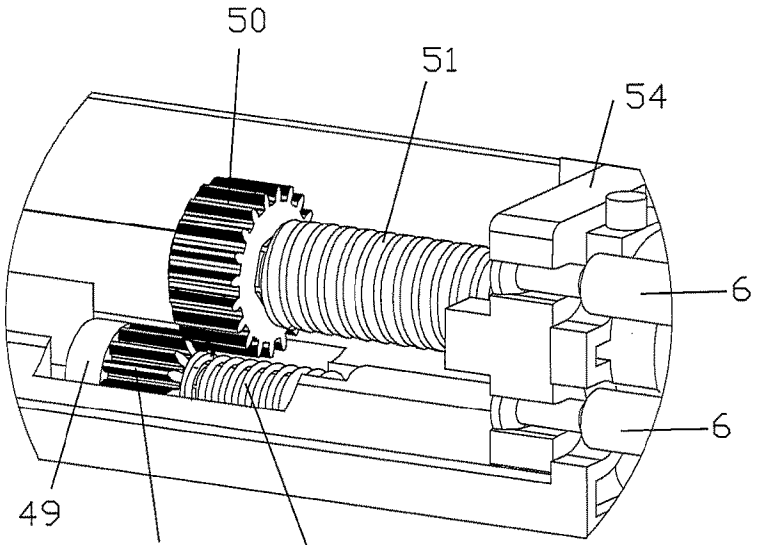
FIG. 20A is a close up view of part 'A' of the closure mechanism of FIG. 20, illustrating the adjustment mechanism disengaged and adjusted to provide the least tension.
Figure 21:
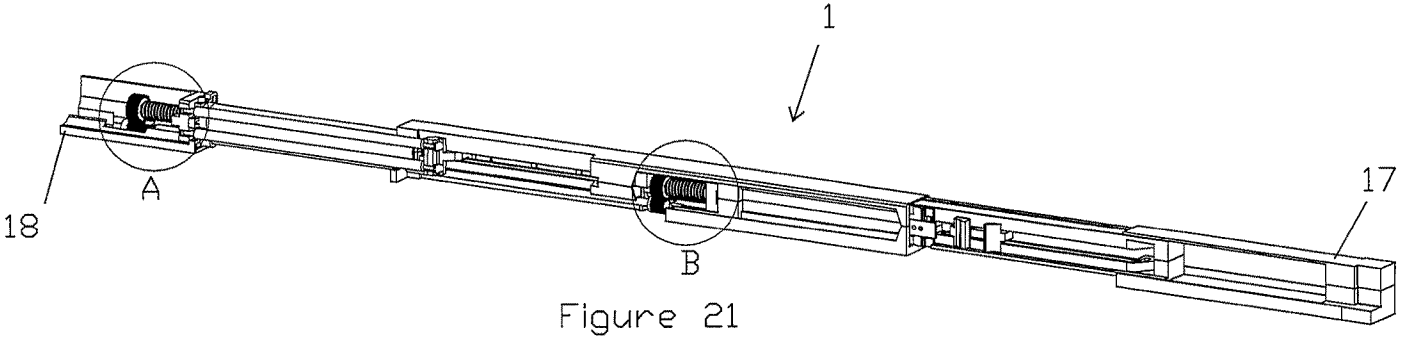
FIG. 21 is a view of an alternative embodiment of the closure mechanism having an adjustable resilient mechanism, illustrating the adjustment mechanism engaged and adjusted to provide the least tension.
Figure 21B:
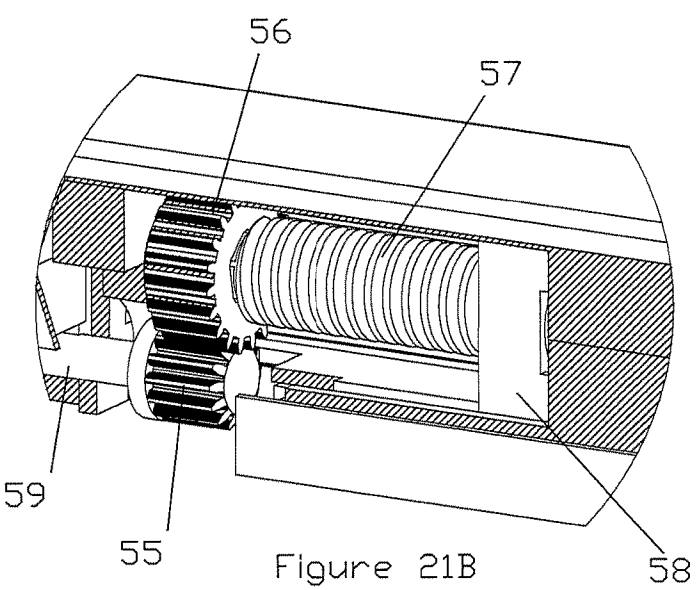
FIG. 21B is a close up view of part 'B' of the closure mechanism of FIG. 21, illustrating the adjustment mechanism engaged and adjusted to provide the least tension.
Figure 21A:
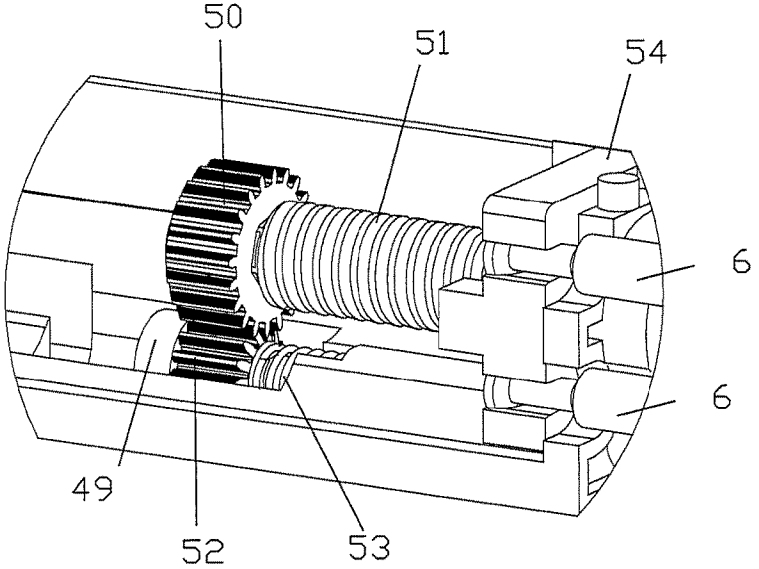
FIG. 21A is a close up view of part 'A' of the closure mechanism of FIG. 21, illustrating the adjustment mechanism engaged and adjusted to provide the least tension.
Figure 22:
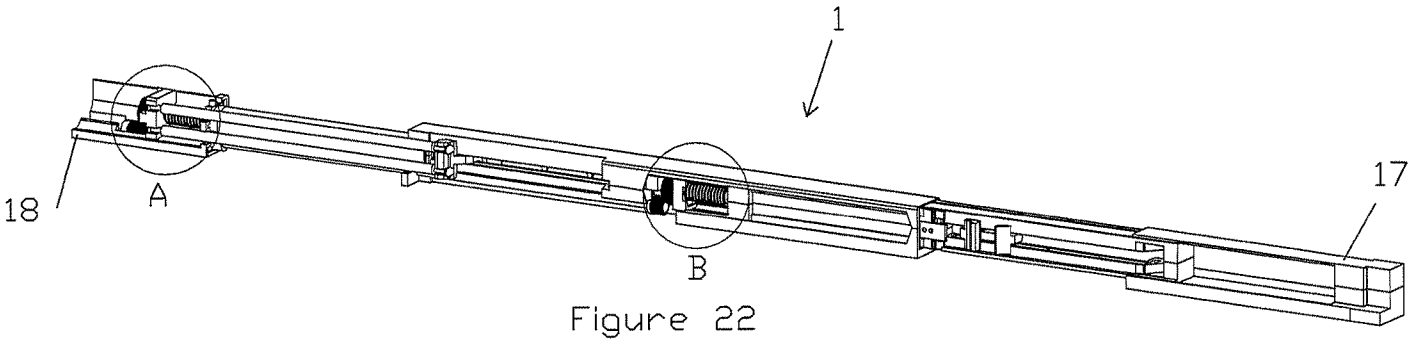
FIG. 22 is a view of an alternative embodiment of the closure mechanism having an adjustable resilient mechanism, illustrating the adjustment mechanism disengaged and adjusted to provide the most tension.
Figure 22B:
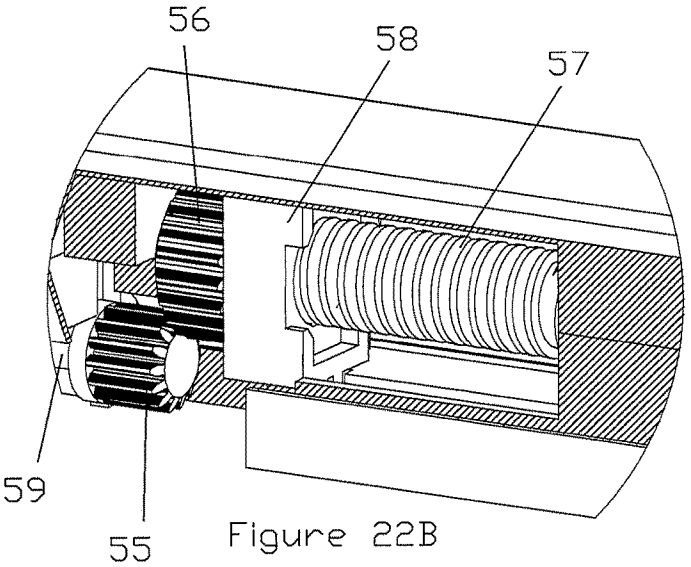
FIG. 22B is a close up view of part 'B' of the closure mechanism of FIG. 22, illustrating the adjustment mechanism disengaged and adjusted to provide the most tension.
Figure 22A:
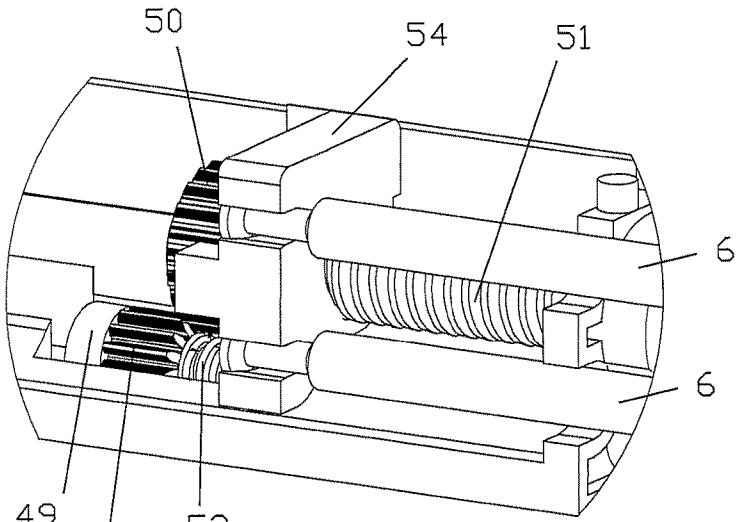
FIG. 22A is a close up view of part 'A' of the closure mechanism of FIG. 22, illustrating the adjustment mechanism disengaged and adjusted to provide the most tension.
Figure 23:
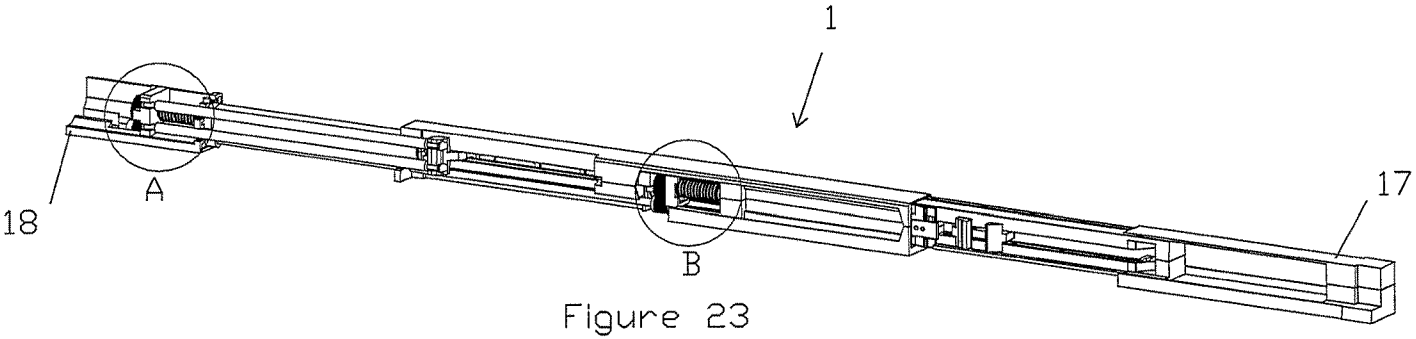
FIG. 23 is a view of an alternative embodiment of the closure mechanism having an adjustable resilient mechanism, illustrating the adjustment mechanism engaged and adjusted to provide the most tension.
Figure 23B:
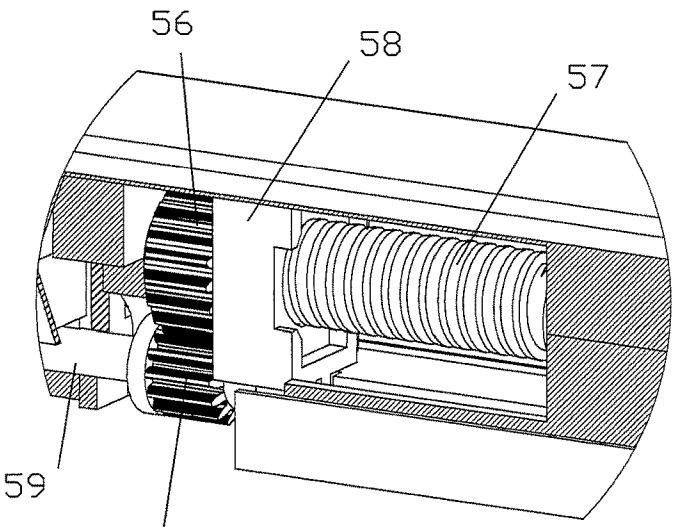
FIG. 23B is a close up view of part 'B' of the closure mechanism of FIG. 23, illustrating the adjustment mechanism engaged and adjusted to provide the most tension.
Figure 23A:
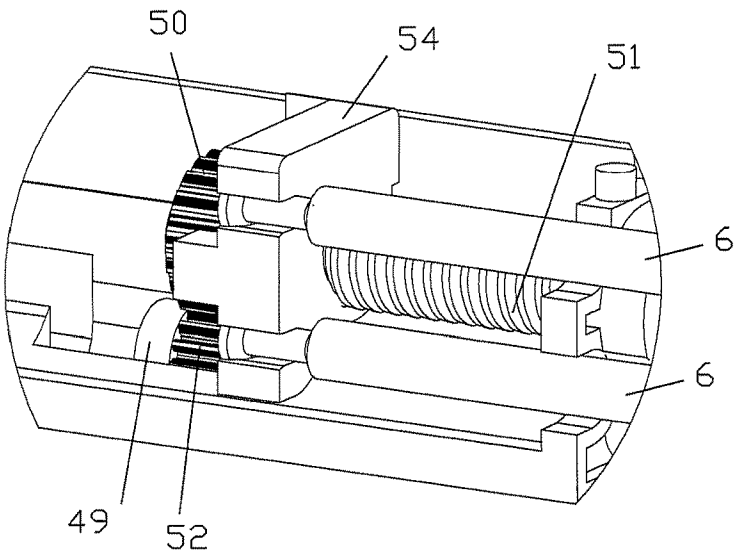
FIG. 23A is a close up view of part 'A' of the closure mechanism of FIG. 23, illustrating the adjustment mechanism engaged and adjusted to provide the most tension.

A further embodiment of the invention can be seen in FIGS. 18 and 19. The closure mechanism 1 seen in FIGS. 18 and 19 has an additional third resilient mechanism 71, a second carriage 73 slidable along a second carriage track or guide path 74, a second carriage track or guide path 74 and a second linkage 75. The additional resilient mechanism 71 allows substantially one third of the force available from closing an object to be used to prime the closure mechanism when opening a panel. While a third extra resilient mechanism has been illustrated it is to be understood that any number of extra resilient mechanisms could be used. Further it could be that multiple resilient mechanisms may be extended/primed at the same time while opening. For example, if four resilient mechanisms are used it may be that two of the resilient mechanisms may be extended/primed at the same time, while on closing the force of all four would be used to close the panel.

A further embodiment of the invention can be seen in FIGS. 20 to 23. The closure mechanism 1 includes an adjustment mechanism to enable the pre-tension of the resilient mechanisms 6, 22 to be adjusted. The adjustment is made when the first end 20 of carriage 3 is at the furthest extent it can travel on the track or guide path 14 towards the first end 18.

The resilient mechanisms 6, 22 are connected to tensioning blocks 54, 58. The tensioning blocks 54, 58 have an internal thread and move along threaded rods 51, 57 as the rods are rotated, the movement of the tensioning blocks 54, 58 adjusting the tension of the resilient mechanisms 6, 22. The least tension can be seen in 20, 20A, 20B, 21, 21A, and 21B. The most tension can be seen in 22, 22A, 22B, 23, 23A, and 23B where the tensioning blocks 54, 58 have expanded resilient mechanisms 6, 22.

The threaded rods 51, 57 have driven gears 50, 56 which rotate the rods 51, 57. The driven gears 50, 56 are driven by drive gears 52, 55. The drive gears 52, 55 are connected by a rotatable shaft 59.

The rotatable shaft 59 and thus the drive gears are rotated using a tool at the shaft end 49. A resilient mechanism 53, in one embodiment a spring forces the shaft to a position where the drive gears 52, 55 are disengaged from the driven gears 50, 56. This can be seen in FIGS. 20, 20A, 20B, 22, 22A, and 22B.

To adjust the tension resilient mechanism 53 is forced, typical using a tool and the drive gears 50, 56 are engaged with the driven gears 50, 56 as seen in FIGS. 21, 21A, 21B, 23, 23A, and 23B. Thus the tension on both resilient mechanisms 6, 22 can be adjusted simultaneous and equally.

This simultaneous adjustment ensures that when an operator opens the door they "feel the same amount" during the stretching of the resilient mechanism as they do when they open the second set (and subsequent sets if present) of resilient mechanisms, creating a consistent feel during opening. The closure mechanism would still work (the door would still close) if there is an adjustment difference between one resilient mechanism and another (i.e. one resilient mechanism set strong, another resilient mechanism set weak) but the operators perception of the closure mechanism would be an uneven and inconsistent feel during opening. Further, the presence of an adjustment difference between resilient mechanism sets will reduce the range of force that the closure mechanism can be adjusted to work with (i.e. the closure mechanism would not be able to be adjusted to the absolute maximum or to the absolute minimum to suit a very sluggish or a very free-moving door, respectively.

Figure 24:
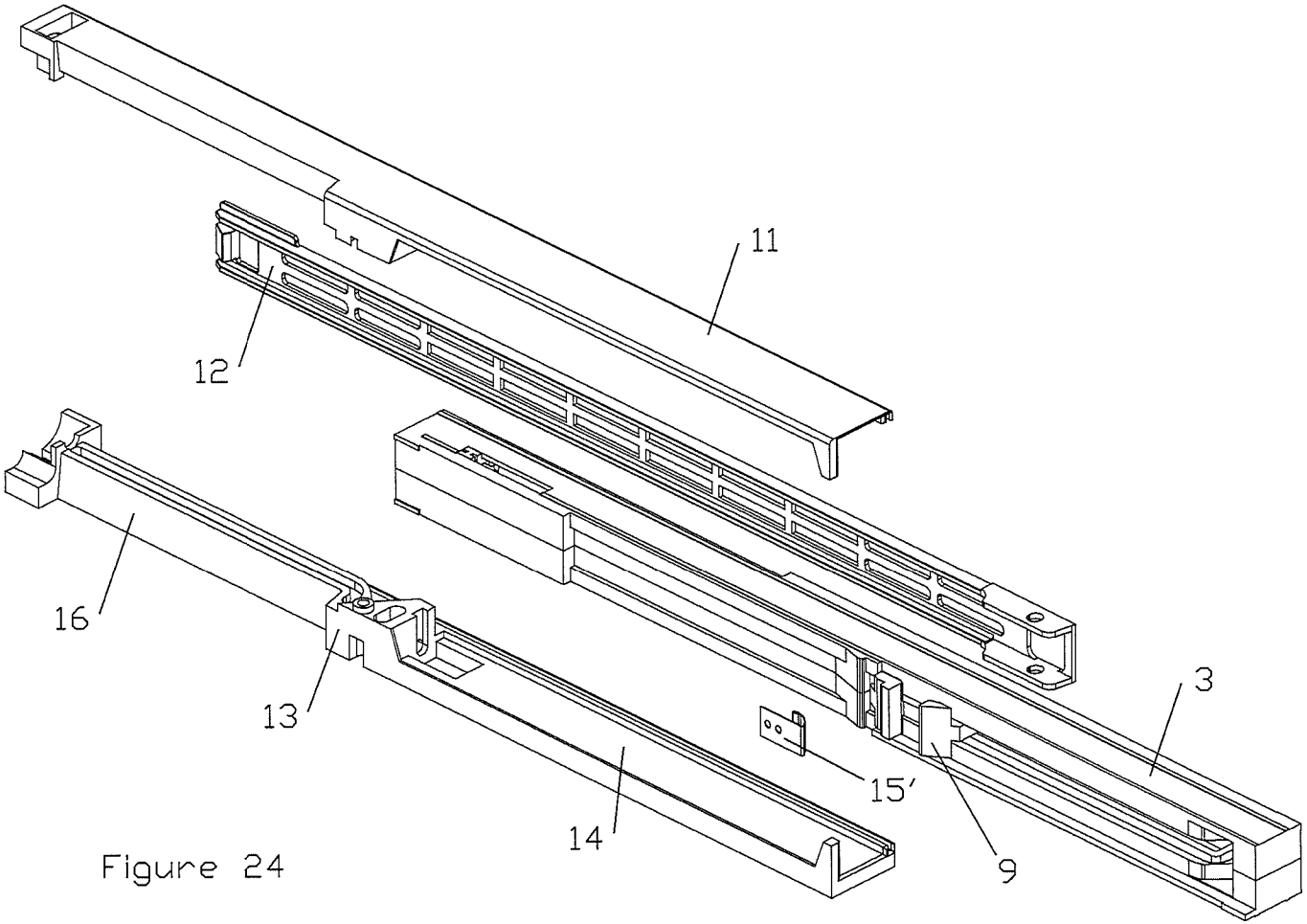
FIG. 24 is a partial assembly view of the closure mechanism of an alternative embodiment.
Figure 25:
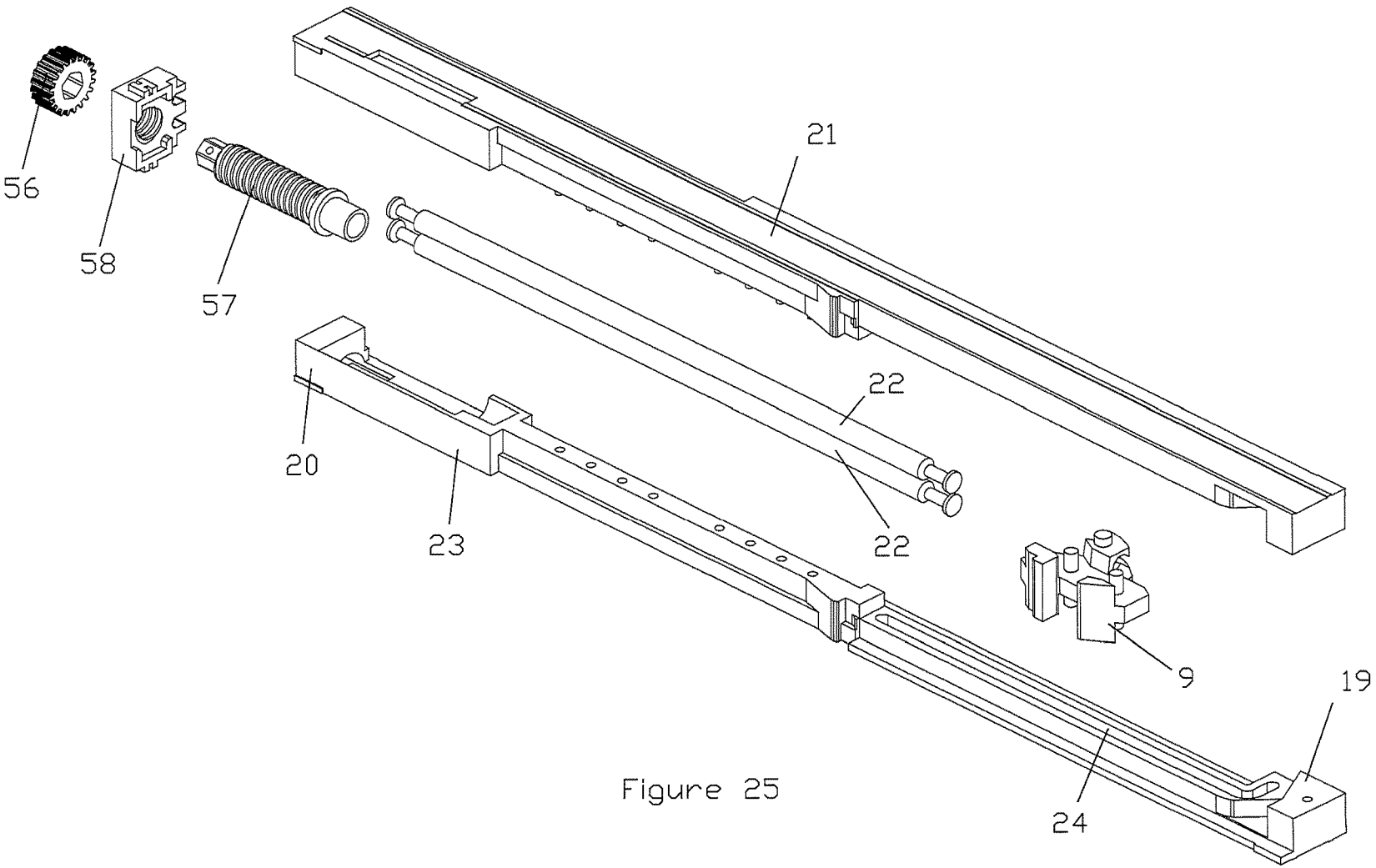
FIG. 25 is an assembly view of the carriage sub assembly of the closure mechanism of an alternative embodiment.

FIGS. 24 and 25 show an alternative embodiment of the closure mechanism that includes an adjustment mechanism to enable the pre-tension of the resilient mechanisms 6, 22 to be adjusted. An alternative latch 15' is shown.

Figure 26:
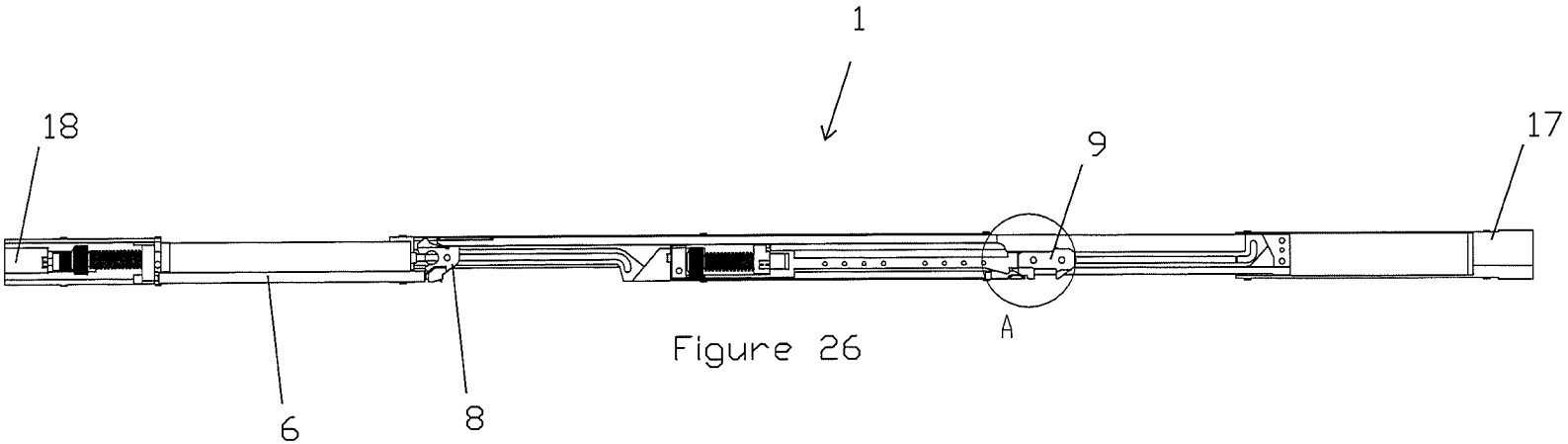
FIG. 26 is a top view of the closure mechanism of an alternative embodiment, illustrating the mechanism in a fully closed position.
Figure 26A:
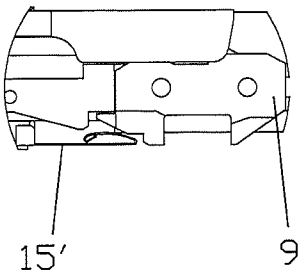
FIG. 26A is a close up view of part 'A' of the closure mechanism of FIG. 26, illustrating the mechanism in a fully closed position.

Referring to FIGS. 26 to 30 the operation of the alternative closure mechanism 1 will now be described. Referring particularly to FIGS. 26, and 26A starting from the closed position where the catching mechanism 9 is nearest the first end 20 of the carriage track or guide path 24 and the carriage 3 is nearest the closed end 18 of the closure mechanism 1 in track or guide path 14. Both resilient mechanisms 6 and 22 are in a relaxed position. The linkage catch 8 is connected to the linkage 12. The latch 15' is pushed away by the catching mechanism 9 allowing the carriage 3 to move in track 14.

The resilient mechanisms 6 and 22 are described as in a relaxed position when they are applying little force on the catching mechanism 9 and in a primed or extended position when they are able to apply force to the catching mechanism 9.

In use when a moveable object is opened the trigger 10 is held by the catching mechanism 9, and as the trigger 10 moves towards the open end 17 of the closure mechanism 1, the first resilient mechanism 6 is extended to a stretched/primed position and the damping mechanism shaft 41 is extended.

Figure 27:
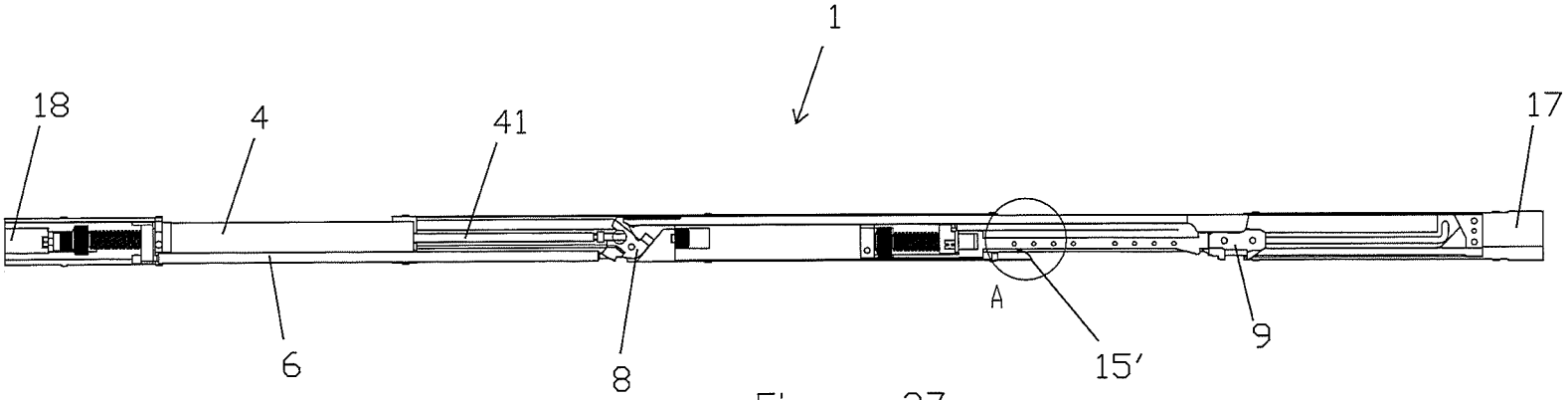
FIG. 27 is a top view of the closure mechanism of an alternative embodiment, illustrating the mechanism in a first partially open position.
Figure 27A:
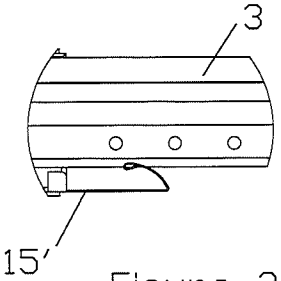
FIG. 27A is a close up view of part 'A' of the closure mechanism of FIG. 27 illustrating the mechanism in a first partially open position.

Referring to FIGS. 27 and 27A the first resilient mechanism 6 and the damping mechanism shaft 41 are extended as the first resilient mechanism 6 and the damping mechanism shaft 41 are connected to the linkage catch 8 which is in turn connected to the catching mechanism 9 via the linkage 12. Thus the first resilient mechanism 6 and the damping mechanism shaft 41 are extended as the linkage catch 8 moves along the linkage catch track or guide path 16 towards the open end of the closure mechanism body 2.

The carriage 3 having been released from the sprung latch 15' also moves along the carriage track or guide path 14 to the end of the carriage track or guide path 14 nearest the open end 17 of the closure mechanism 1. At this stage the closure mechanism has only extended the first resilient mechanism 6, the second resilient mechanism 22 has not been extended at all. A force sufficient to extend the first resilient mechanism 6 and the damping mechanism shaft 41 is only required. As the second resilient mechanism 22 is not extended at the same time no force is acting on the second resilient mechanism 22.

As the trigger 10 moves further towards the open end 17 of the closure mechanism 1, the linkage catch 8 disengages from the linkage 12 and the catching mechanism 9 slides along towards the second end of the closure mechanism body in track or guide path 24. The first resilient mechanism 6 and the damping mechanism shaft 41 remain in an extended position held by the linkage catch 8.

Figure 28:
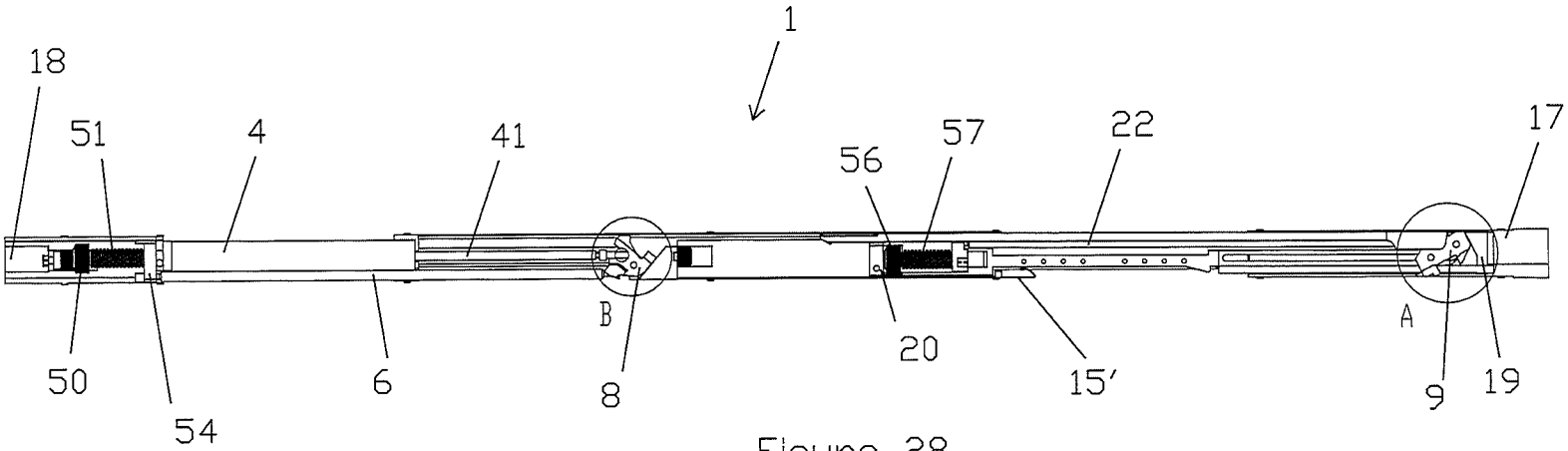
FIG. 28 is a top view of the closure mechanism of an alternative embodiment, illustrating the mechanism in a fully open position.
Figure 28A:
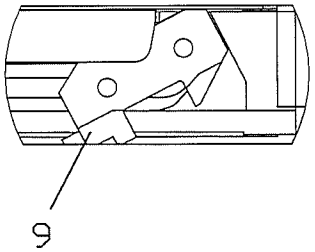
FIG. 28A is a close up view of part 'A' of the closure mechanism of FIG. 28 illustrating the mechanism in a fully open position.
Figure 28B:
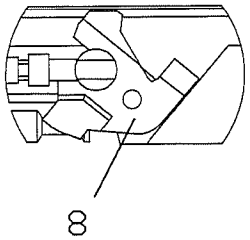
FIG. 28B is a close up view of part 'A' of the closure mechanism of FIG. 28 illustrating the mechanism in a fully open position.

Referring to FIGS. 28, 28A and 28B as the trigger 10 moves towards the open end 17 of the closure mechanism 1 the catching mechanism 9 moves along the carriage track or guide path 24 and extends the second resilient mechanism 22. As the trigger 10 moves further away from the closed position the catching mechanism 9 releases the trigger and the catching mechanism 9 holds the second resilient mechanism 22 in an extended position. As the first resilient mechanism 6 is not being extended at this time no force is acting on the first resilient mechanism 6 while the second resilient mechanism 22 is extended, thus the full force available from closing has not been required to open/prime the closure mechanism 1.

Figure 29:
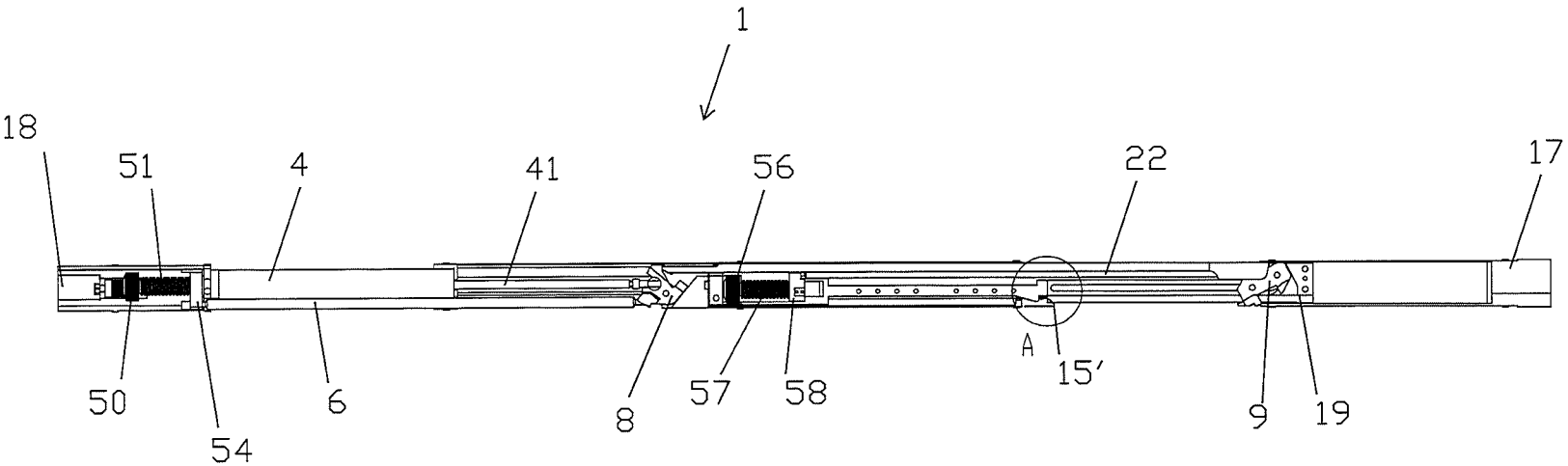
FIG. 29 is a top view of the closure mechanism of an alternative embodiment, illustrating the mechanism in a first partially closed position.
Figure 29A:
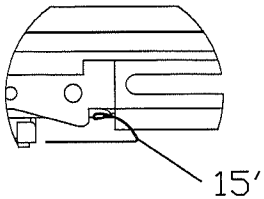
FIG. 29A is a close up view of part 'A' of the closure mechanism of FIG. 29 illustrating the mechanism in a first partially closed position.

From an open position seen in FIGS. 28, 28A and 28B as a panel in use is moved towards the closed end 18 of the closure mechanism 1 the trigger 10 connects with the catching mechanism 9. As seen in FIGS. 29 and 29A the carriage 3 slides along the carriage track or guide path 14 until the linkage 12 connects with the linkage catch 8 and the latch 15' operates to hold the carriage 3 at the furthest extent of the carriages travel along track 14 in the direction of end 18.

At this stage the first resilient member 6 and the second resilient member 22 are still fully extended. Then as the linkage 12 connects with the linkage catch 8 the first resilient member 6 and the second resilient member 22 begin to simultaneously compress/close applying the force of both resilient mechanisms 6, 22 at the same time.

Figure 30:
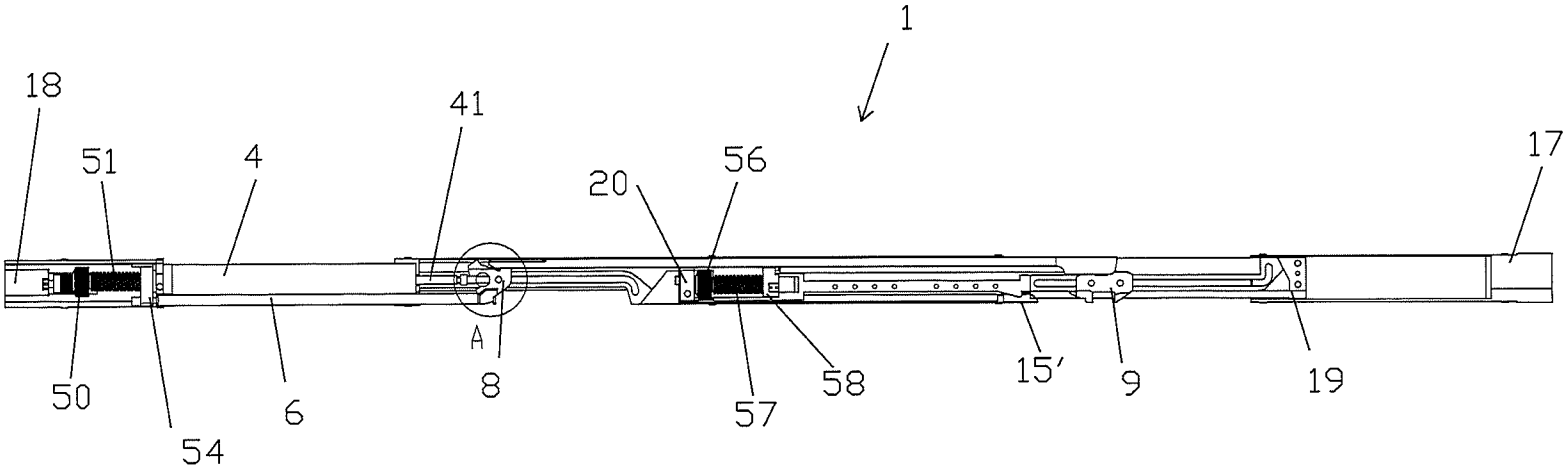
FIG. 30 is a top view of the closure mechanism of an alternative embodiment, illustrating the mechanism in a second partially closed position.
Figure 30A:
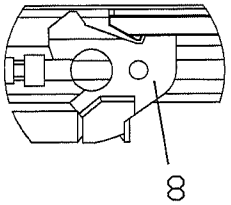
FIG. 30A is a close up view of part 'A' of the closure mechanism of FIG. 30 illustrating the mechanism in a second partially closed position.

The damping mechanism shaft 41 moves within the damping mechanism 4 and provides a damping force as the panel closes. As shown in FIGS. 30 and 30A the latch 15' is still operable to secure the carriage 3 in position until the catching mechanism 9 returns to the closed position seen in FIGS. 26 and 26A and the latch 15' is pushed away by the catching mechanism 9 allowing the carriage 3 to move in track 14.

Further while the closure mechanism 1 has been described as closing a closable object the closure mechanism 1 can also be used to position an object for example positioning a door in an open position. Additionally, multiple closure mechanisms could be used so that one closure mechanism positions a door in a closed position and another positions the door in an open position. Such an example would be a door mounted in a hidden frame. The closure mechanism could also be used to position an object in a position that is neither open nor closed, such as positioning a dividing panel of a room. Closing is to be understood to refer to closing an object and to positioning an object in a closed position or any other position.

Figure 31:
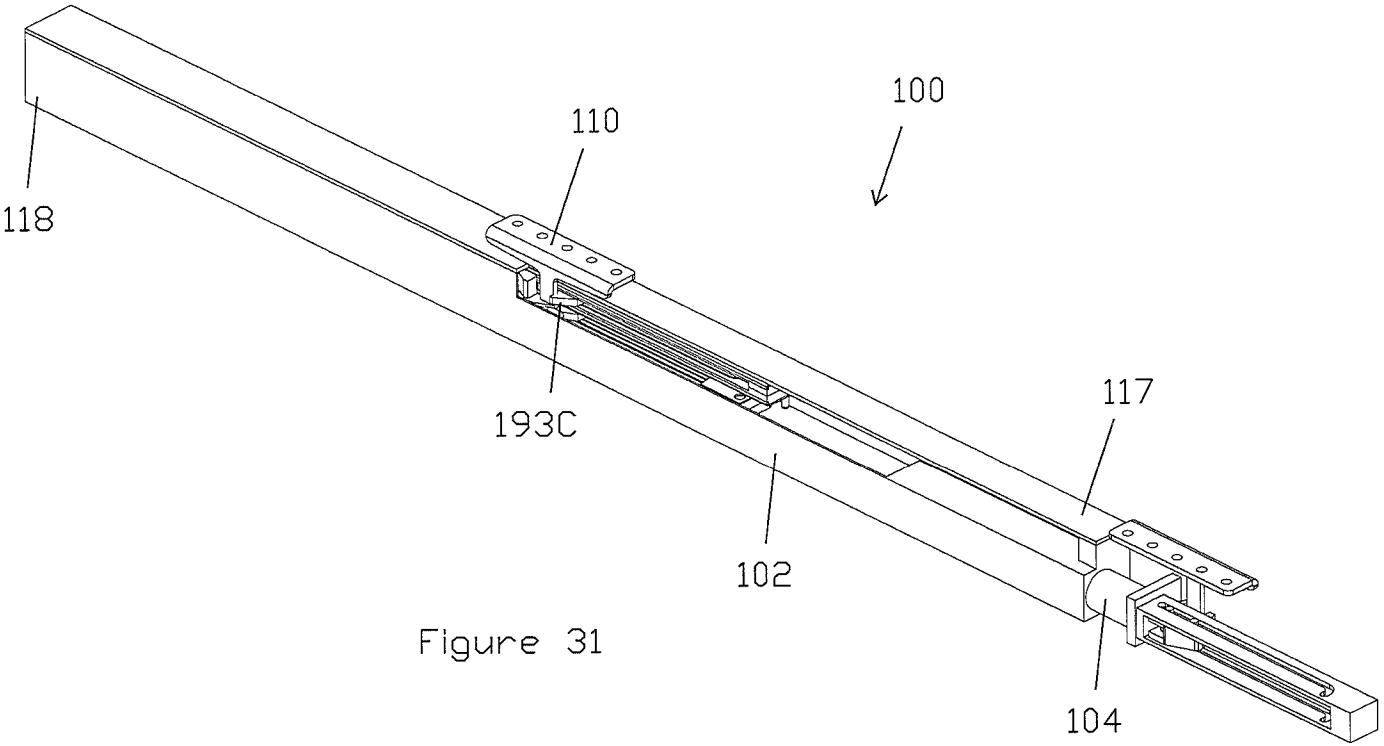
FIG. 31 is a view of the closure mechanism of an alternative embodiment.
Figure 32:
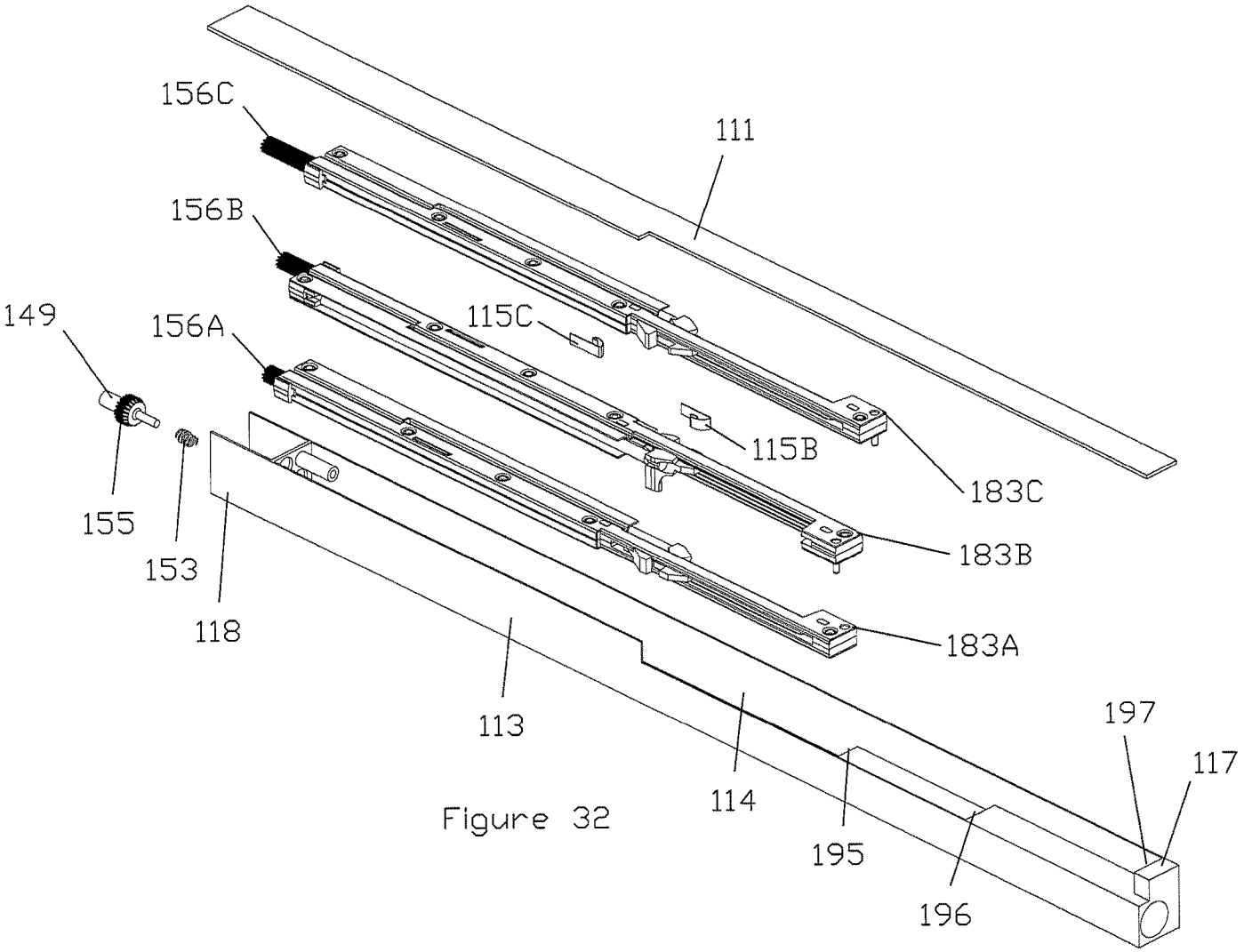
FIG. 32 is a partial assembly view of the closure mechanism of an alternative embodiment.
Figure 33:
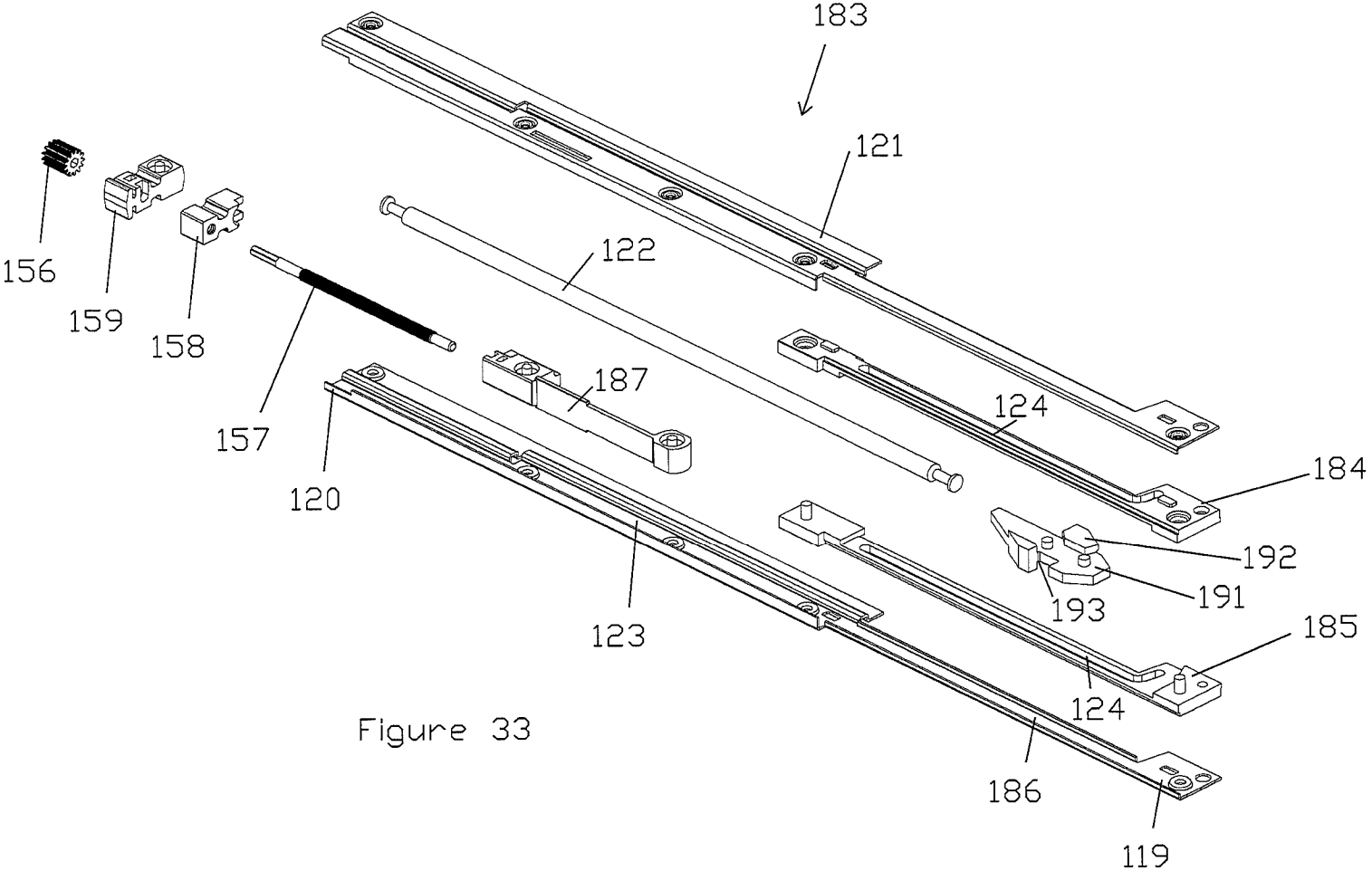
FIG. 33 is an assembly view of the subassembly of the closure mechanism of an alternative embodiment.

Referring to FIGS. 31 to 33 the configurable closure mechanism 100 of the present invention is illustrated. The configurable closure mechanism 100 includes an elongated closure mechanism body 102. The closure mechanism body 102 consists of an upper closure mechanism body 111 and a lower closure mechanism body 113. The configurable closure mechanism 100 has a first end 118 which in use is located in the direction that the slidable object moves to close and a second end 117 which in use is located in the direction in which the slidable object moves to open.

A plurality of subassemblies 183A, 183B. 183C are located in a path 114 in the lower closure mechanism body 113. One of the subassemblies 183A is fixed near the first end while other subassemblies 183B and 183C are movable along the closure mechanism body 102 in guide path 114. Stops 195, 196 and 197 located in the guide path limit the movement of the subassemblies 183A, 183B. 183C respectively.

Slidable within each subassembly 183 is a carriage 191 having at least one connecting mechanism and optionally two connecting mechanisms 192, 193. When referring to a part of a specific subassembly A, B or C the letter associated with the subassembly has been added to the reference numeral, when referring to the parts of all the subassemblies or a representative subassembly the letter associated with the subassembly is left off.

One of the subassemblies 183C has a carriage 191C with a connecting mechanism 193C which acts as a catch, which in use, catches a trigger 110. If the configurable closure mechanism 100 is mounted in the slidable object, then the trigger 110 is mounted on the frame. However as discussed above the closure mechanism could be mounted on or in a frame and so the trigger 110 could be mounted on the slidable object.

A damping mechanism 104 may also be provided to dampen the movable object as the object moves to a closed position.

Each subassembly 183 has an upper body 121 and a lower body 123, spacers 159, 187 assist in keeping the upper 121 and lower body 123 apart. Each subassembly 183 has a first end 120 nearest the closed end 118 of the closure mechanism 100 and a second end 119 nearest the open end 117 of the closure mechanism 100. The subassembly 183 includes a subassembly track or guide path 124 along which slides a carriage 191. The guide path has upper 184 and lower 185 components. A resilient mechanism 122 connects between the carriage 191 and first end 120 of the subassembly 183. The resilient mechanism 122 is operable to provide a closing force.

Figure 34:
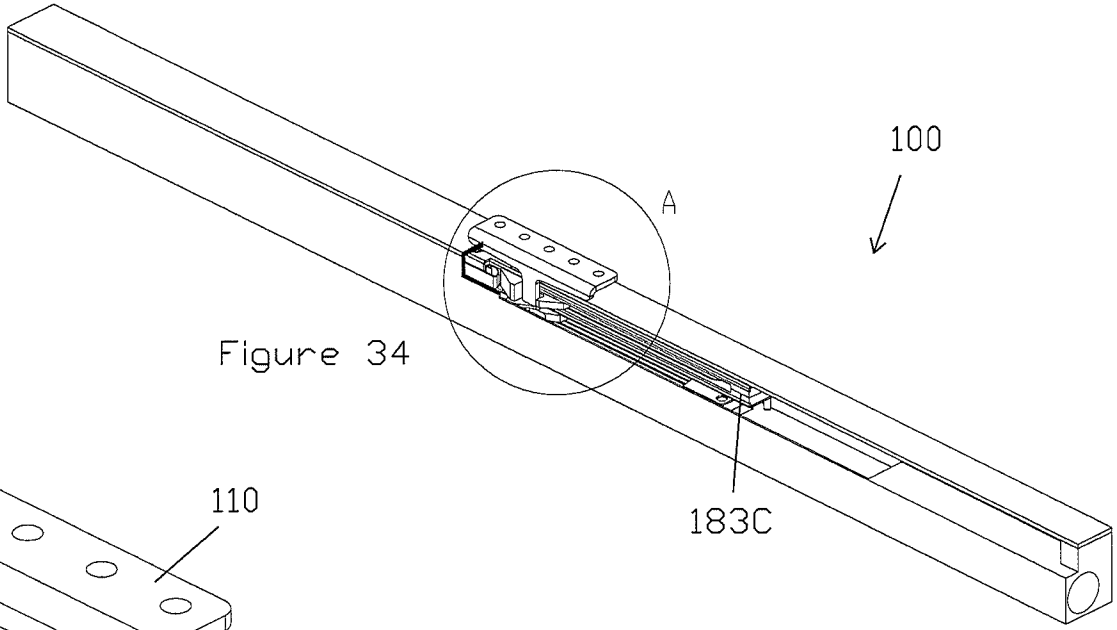
FIG. 34 is a partial view of the closure mechanism of an alternative embodiment in position showing the latch engaged.
Figure 34A:
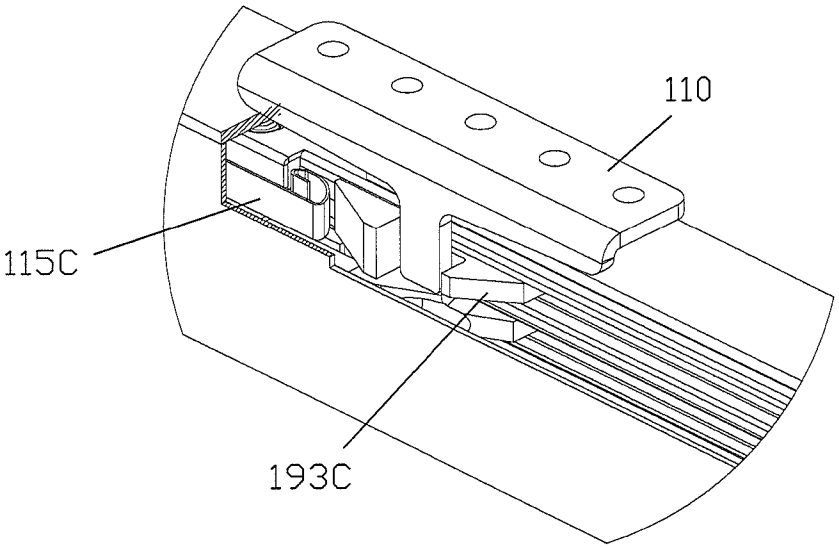
FIG. 34A is a close up view of part 'A' of the closure mechanism of FIG. 34 in position showing the latch engaged.

Referring to FIGS. 34 and 34A a latch 115 assists in securing the subassembly 183C in position at the furthest extent it can travel on the guide path 114 towards the first end 118. As can be seen in FIG. 34A up until the moment before the carriage 191C is at the further extent it can travel in track 124C towards the first end 118 the latch 115C applies a force to the subassembly 183C to assist the subassembly 183C to stay in position. As the carriage 191C reaches the furthest extent it can travel in track 124C towards the first end 118 the latch 115C is moved by the carriage 191C allowing the subassembly 183C to move in path 114.

The resilient mechanism 122 may again be a spring or any other suitable resilient mechanism such as a rubber spring. In one embodiment the resilient mechanism 122 each consist of one spring, alternatively the resilient mechanism may consist of a pair of springs. Alternative resilient mechanisms such as rubber may be used.

The configurable closure mechanism body 112 and other components may be made of plastic or metal or any other suitable material or any combination thereof. Preferably the tracks offer low resistance to the sliding components of the configurable closure mechanism 100.

Figure 35:
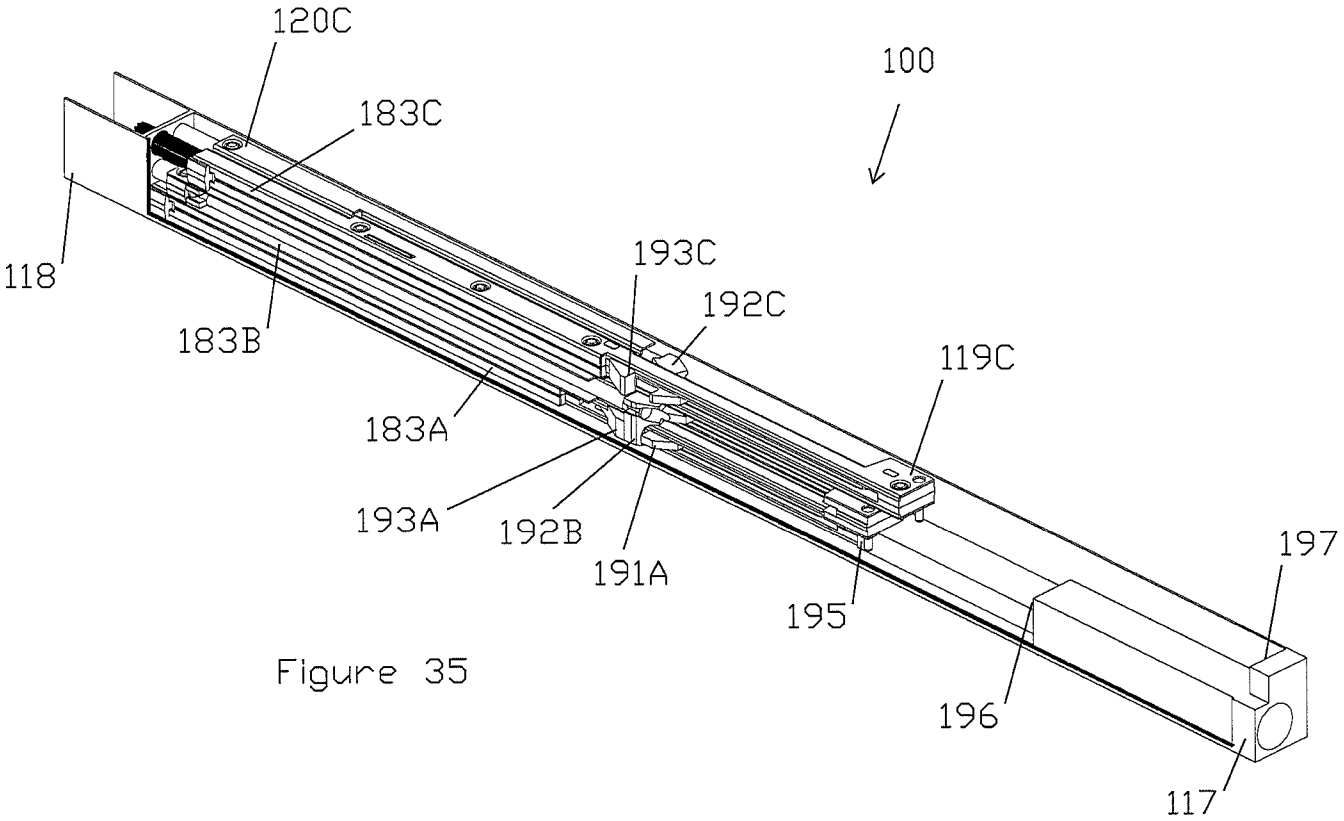
FIG. 35 is a partial view of the closure mechanism of an alternative embodiment, illustrating the mechanism in a fully closed position.

Referring to FIGS. 35 to 40 the operation of the closure mechanism 100 will now be described. Referring particularly to FIG. 35 starting from the closed position where the connecting mechanism 193C is nearest the first end 118 of the guide path 114 and all the carriages 191A, 191B, 191C are nearest the closed end 118 of the closure mechanism 100 in their respective carriage track or guide path 124A, 124B, 124C. All resilient mechanisms 122 of each subassembly 183A, 183B, 183C are in a relaxed position. The carriage connecting mechanism 193A of the carriage of subassembly 183A is connected to the connecting mechanism 192B of the carriage of subassembly 183B. The carriage connecting mechanism 193B of the carriage of subassembly 183B is connected to the connecting mechanism 192C of the carriage of subassembly 183C. The latches 115B and 115C associated with subassemblies 183B and 183C are pushed out by the connecting mechanisms 193B and 193C allowing the carriages of each subassembly 191 to move in tracks 124 of each subassembly.

The resilient mechanisms 122 are described as in a relaxed position when they are applying little force on the carriages 191 and in a primed or extended position when they are able to apply force to the carriages 191 and the connecting mechanism 193C.

In use when a moveable object is opened the trigger 110 is held by the connecting mechanism 193C, and as the trigger 110 moves towards the open end 117 of the closure mechanism 100, the first resilient mechanism 122A is extended to a stretched/primed.

Figure 36:
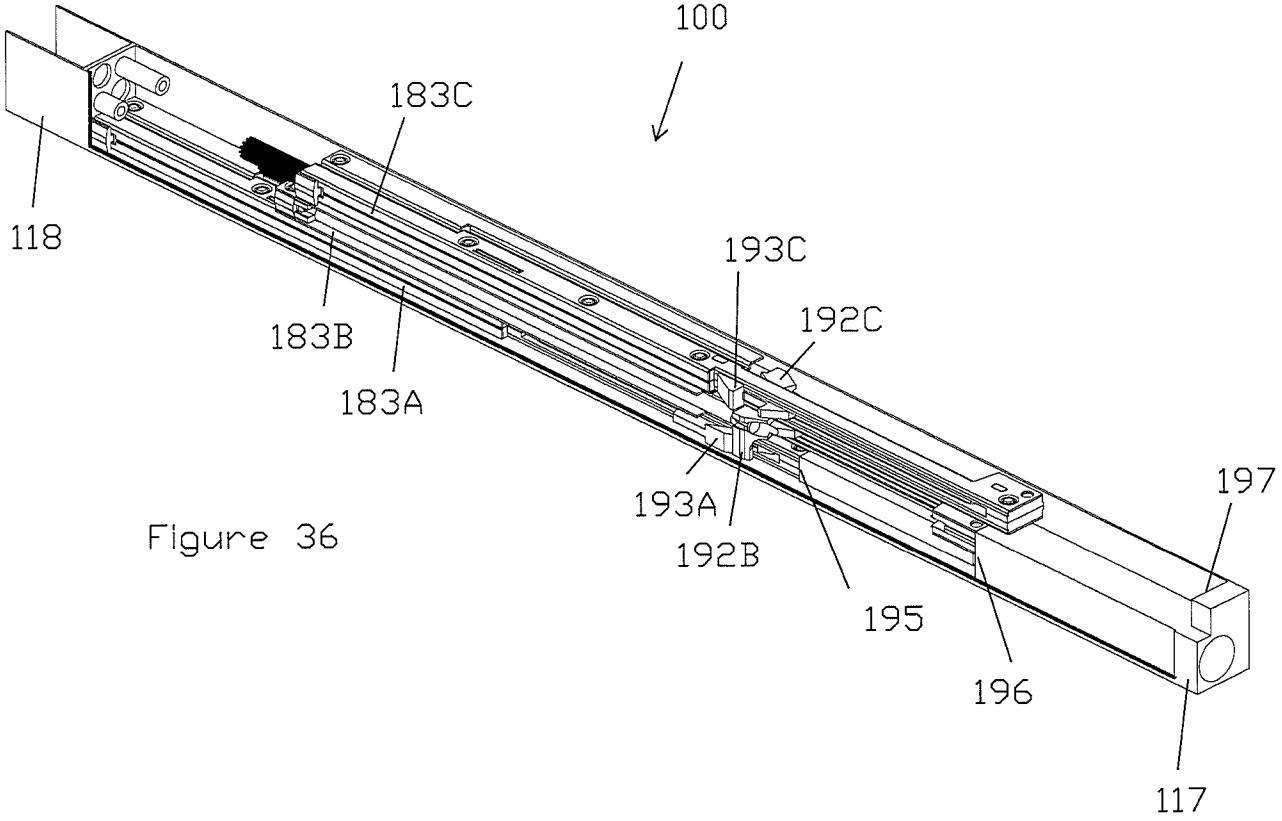
FIG. 36 is a partial view of the closure mechanism of an alternative embodiment, illustrating the mechanism in a first partially open position.

Referring to FIG. 36 the first resilient mechanism 122A is extended as the first resilient mechanism 122A is connected via carriage 191A to the connecting mechanism 193A, which is in turn connected to the connecting mechanism 192B, which is connected via carriage 191B to connecting mechanism 193B, which is in turn connected to connecting mechanism 192C, which is connected to connecting mechanism 193C, via carriage 191C. Thus the first resilient mechanism 122A is extended as the carriage 191A moves along the carriage track or guide path 124A towards the open end of the closure mechanism body 102.

Subassembly 183B also moves along the guide path 114 towards the open end 117 of the closure mechanism 100 until it hits stop 196. At this stage the closure mechanism 100 has only extended the first resilient mechanism 122A, the second resilient mechanism 122B has not been extended at all. A force sufficient to extend only the first resilient mechanism 122A is required. As the second resilient mechanism 122B is not being extended at the same time no force from trigger 110 is acting on the second resilient mechanism 122B.

As the trigger 110 moves further towards the open end 117 of the closure mechanism 100, the connecting mechanism 192B disengages from the connecting mechanism 193A and the carriage 191B slides along towards the second end of the closure mechanism body in carriage guide path 124B. The first resilient mechanism 122A remains in an extended position held by the carriage 191A.

Figure 37:
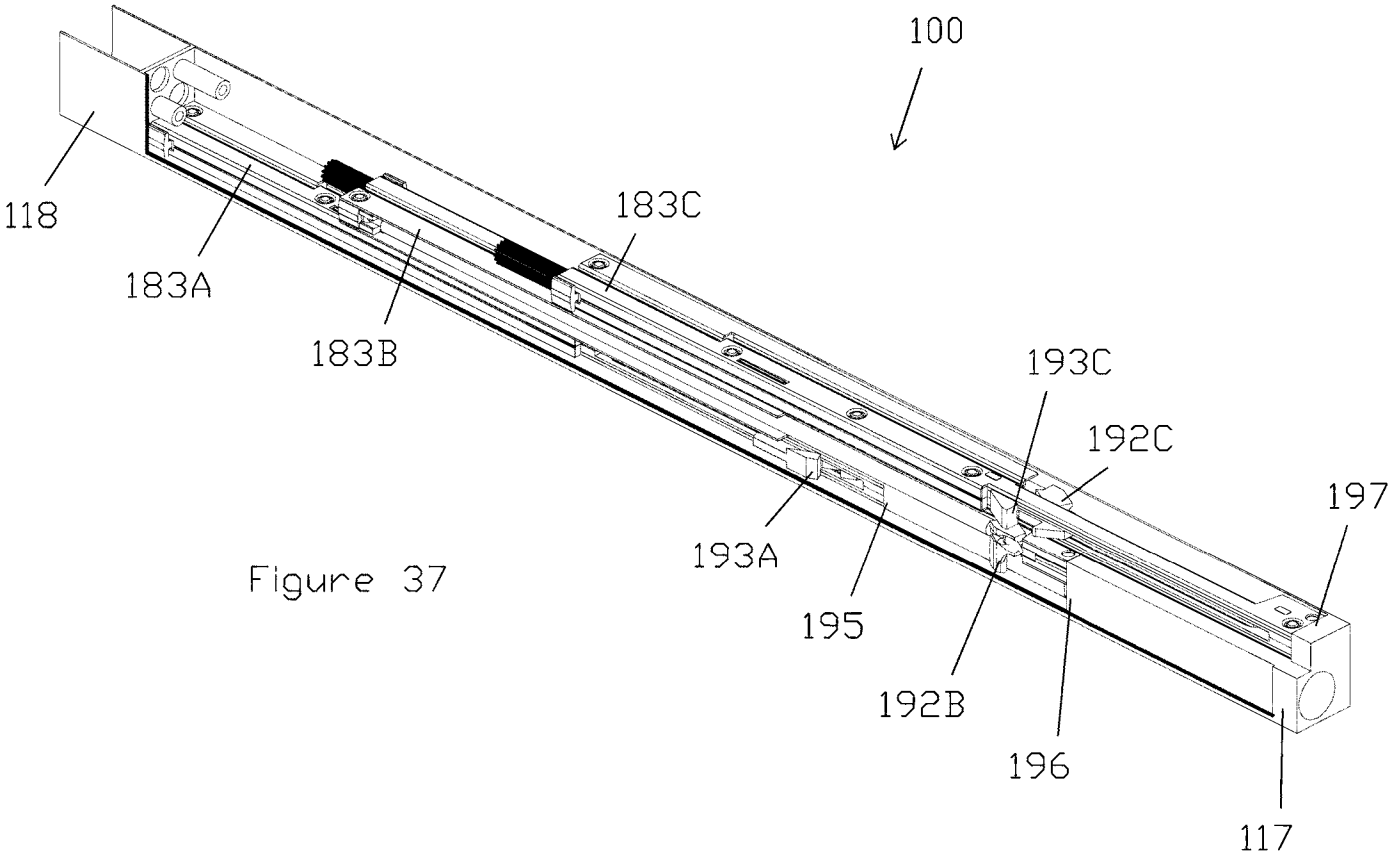
FIG. 37 is a partial view of the closure mechanism of an alternative embodiment, illustrating the mechanism in a second partially open position.

Referring to FIG. 37 the second resilient mechanism 122B is extended as the second resilient mechanism 122B is connected via carriage 191B to the connecting mechanism 193B, which is in turn connected to connecting mechanism 192C, which is connected via carriage 191C to connecting mechanism 193C. Thus the second resilient mechanism 122B is extended as the carriage 191B moves along the carriage track or guide path 124B towards the open end of the closure mechanism body 102.

Subassembly 183C also moves along the guide path 114 towards the open end 117 of the closure mechanism 100 until it hits stop 197. At this stage the closure mechanism 100 has only extended the first and second resilient mechanisms 122A, 122B, the third resilient mechanism 122C has not been extended at all. A force at any given time sufficient to extend only the single resilient mechanism 122B is required. As the third resilient mechanism 122C is not extended at the same time as second resilient mechanism 122B no force from trigger 110 is acting on the third resilient mechanism 122C.

As the trigger 110 moves further towards the open end 117 of the closure mechanism 100, the connecting mechanism 192C disengages from the connecting mechanism 193B and the carriage 191C slides along towards the second end of the closure mechanism body in carriage guide path 124C. The second resilient mechanism 122B remains in an extended position held by the carriage 191B.

Figure 38:
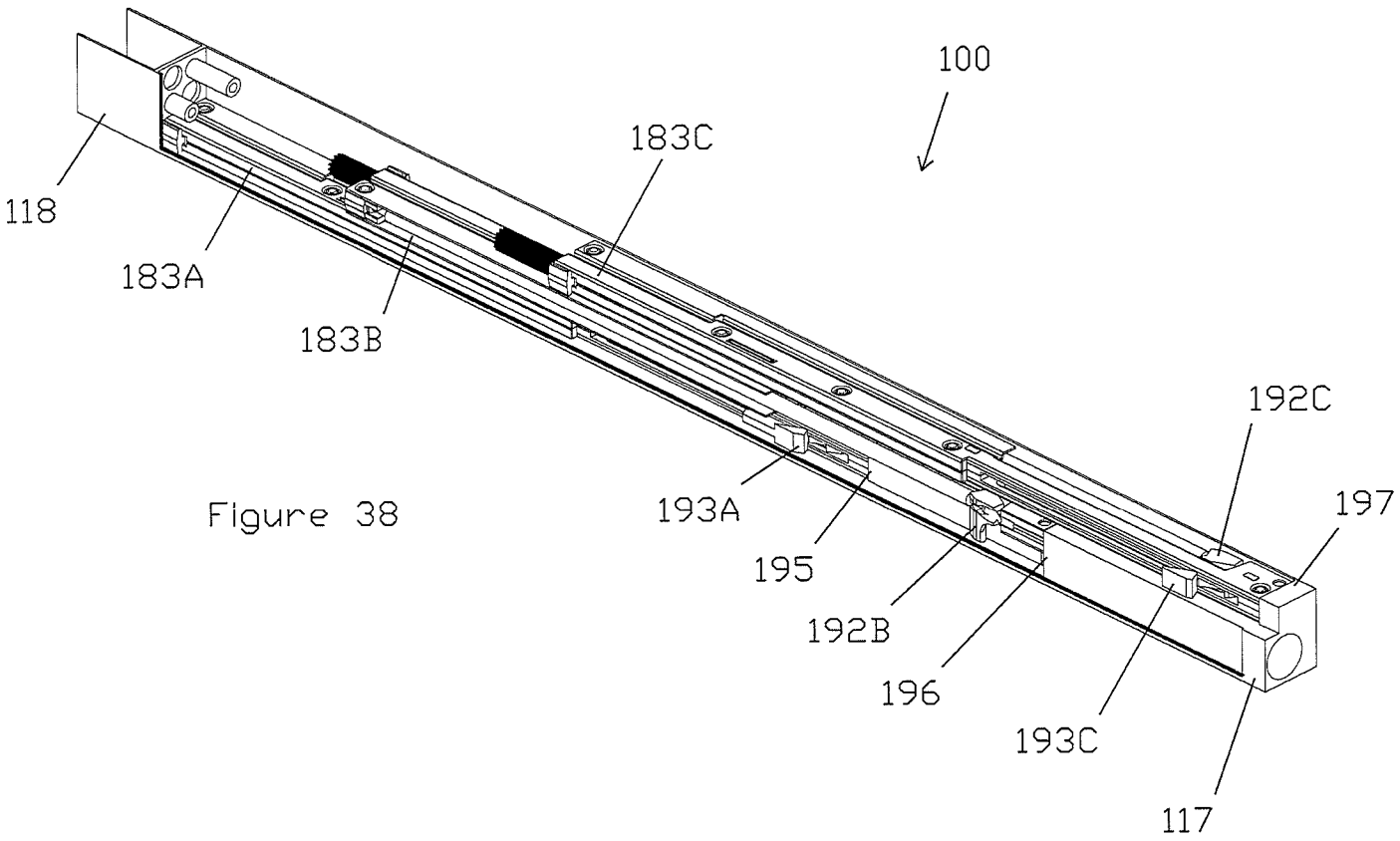
FIG. 38 is a partial view of the closure mechanism of an alternative embodiment, illustrating the mechanism in fully open position.

Referring to FIG. 38 the third resilient mechanism 122C is extended as the third resilient mechanism 122C is connected via carriage 191C to the connecting mechanism 193C. Thus the third resilient mechanism 122C is extended as the carriage 191C moves along the carriage track or guide path 124 towards the open end of the closure mechanism body 102.

A force at any given time sufficient to extend only a single resilient mechanism 122C is required. Thus the full force available from closing has not been required to open/prime the closure mechanism 100.

Figure 39:
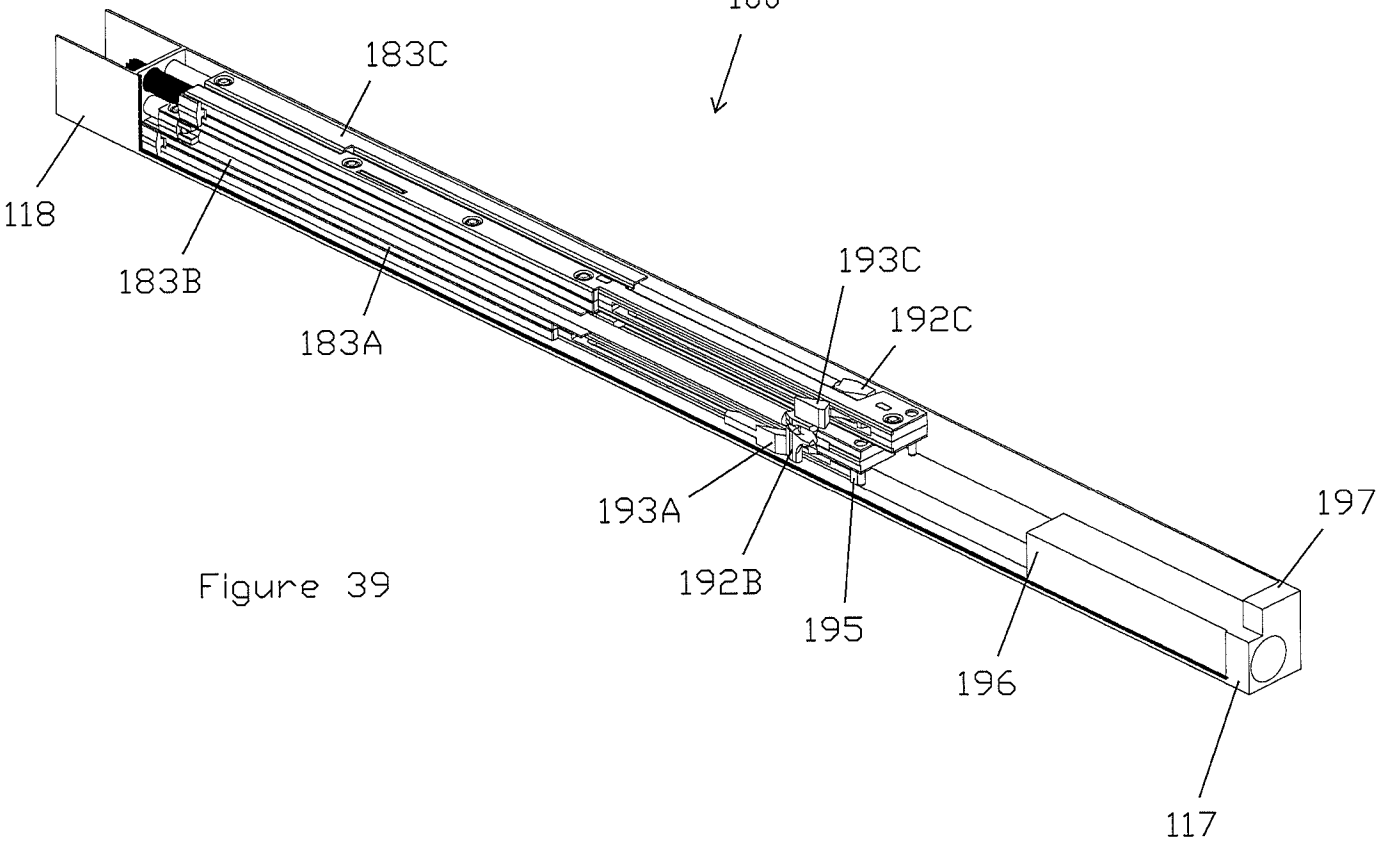
FIG. 39 is a partial view of the closure mechanism of an alternative embodiment, illustrating the mechanism in a first partially closed position.
Figure 40:
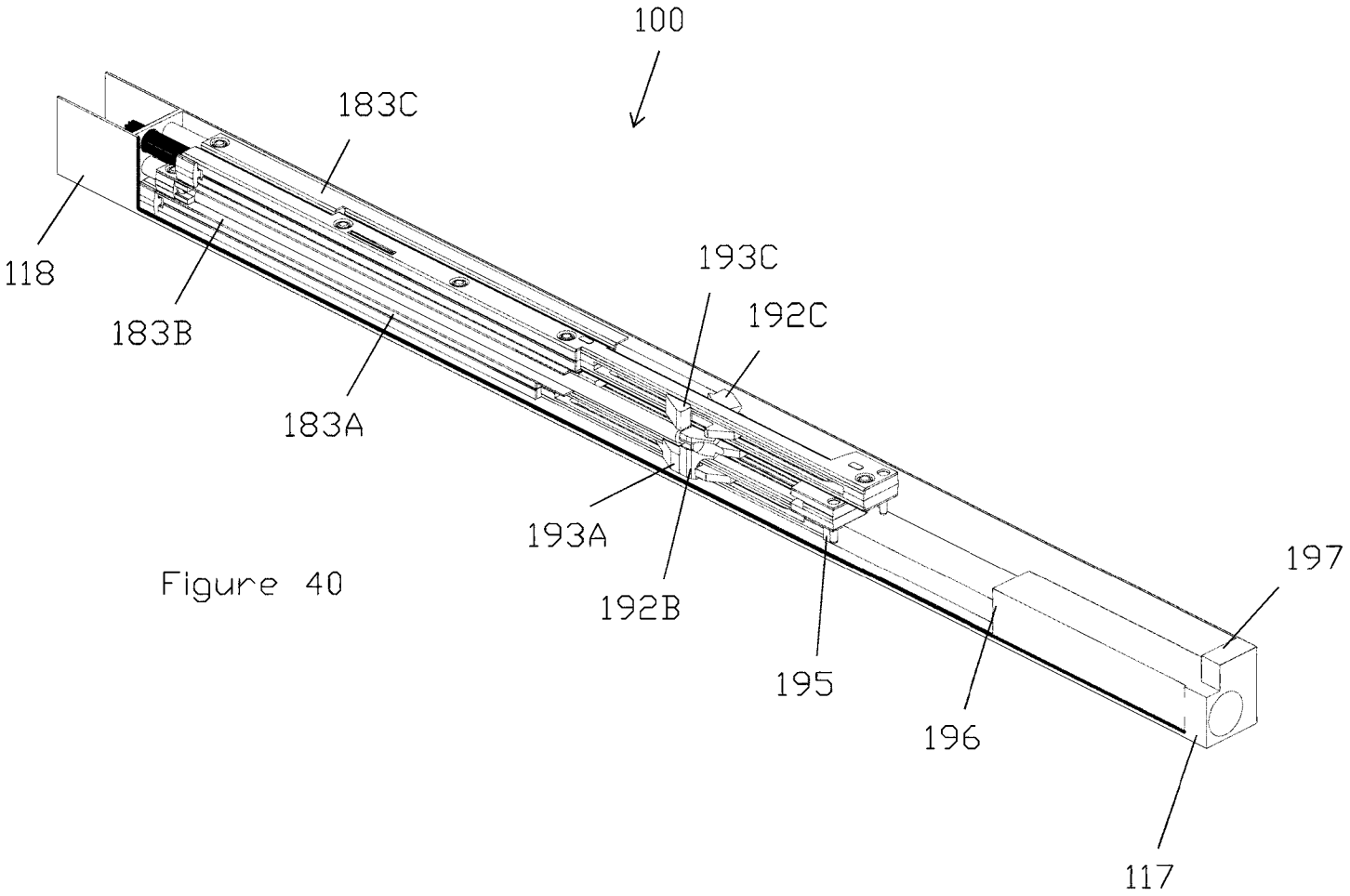
FIG. 40 is a partial view of the closure mechanism of an alternative embodiment, illustrating the mechanism in a second partially closed position.
Figure 41:
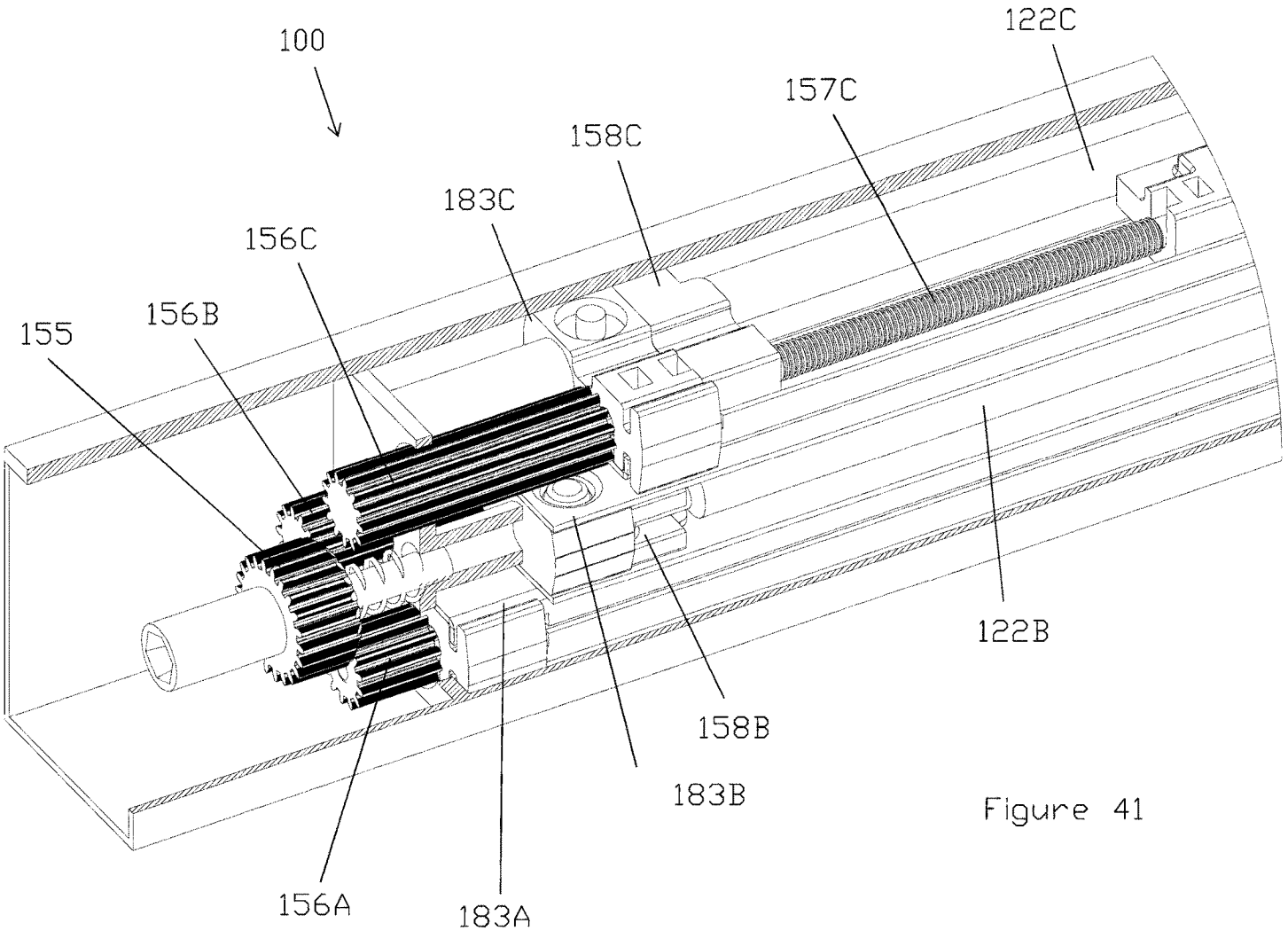
FIG. 41 is a view of an alternative embodiment of the closure mechanism having an adjustable resilient mechanism, illustrating the adjustment mechanism disengaged and adjusted to provide the most tension.

From an open position seen in FIG. 38 as a panel in use is moved towards the closed end 118 of the closure mechanism 100 the trigger 110 connects with the connecting mechanism 193C. As seen in FIG. 39 the subassemblies 183B and 183C slide along the guide path 114 until the connecting mechanisms 192, 193 connect with the connecting mechanisms 192, 193 of other subassemblies, the latches 115B, 115C operate to hold the subassemblies 183B and 183C at the furthest extent of the subassemblies travel along track 114 in the direction of end 118.

At this stage all the resilient members 122A, 122B, 122C are still fully extended. Then as the connecting mechanisms 192, 193 connect with connecting mechanisms 192, 193 of the other subassemblies all the resilient members 122 begin to simultaneously compress/close applying the force of all resilient mechanisms 122 at the same time. This can be seen in FIG. 40.

While three resilient mechanisms have been illustrated it is to be understood that any number of extra resilient mechanisms could be used, for example two or four. Further it could be that multiple resilient mechanisms may be extended/primed at the same time while opening. For example, if eight resilient mechanisms are used it may be that two of the resilient mechanisms may be extended/primed at the same time, while on closing the force of all eight would be used to close the panel.

Referring to FIGS. 41 to 44, the configurable closure mechanism 100 may include an adjustment mechanism to enable the pre-tension of the resilient mechanisms 122 of each subassembly 183 to be adjusted. The adjustment is made when the subassemblies 183 are in position at the furthest extent they can travel on the guide path 114 towards the first end 118.

The resilient mechanisms 122 of each subassembly 183 are connected to tensioning blocks 158A, 158B and 158C. The tensioning blocks 158 have an internal thread and move along threaded rods 157A, 157B and 157C as the rods are rotated, the movement of the tensioning blocks 158A, 158B and 158C adjusting the tension of the resilient mechanisms 122A, 122B, 122C respectively. The least tension can be seen in FIGS. 43 and 44. The most tension can be seen in FIGS. 41, 42 and 45 where the tensioning blocks 158 have expanded resilient mechanisms 122.

The threaded rods 157 have driven gears 156A, 156B and 156C which rotate the rods 157. The driven gears 156A, 156B and 156C are driven by drive gear 155.

The drive gear 155 is rotated using a tool at the shaft end 149. A resilient mechanism 153, in one embodiment a spring, forces the shaft to a position where the drive gear 155 is disengaged from the driven gears 156A, 156B and 156C. This can be seen in FIG. 41.

Figure 42:
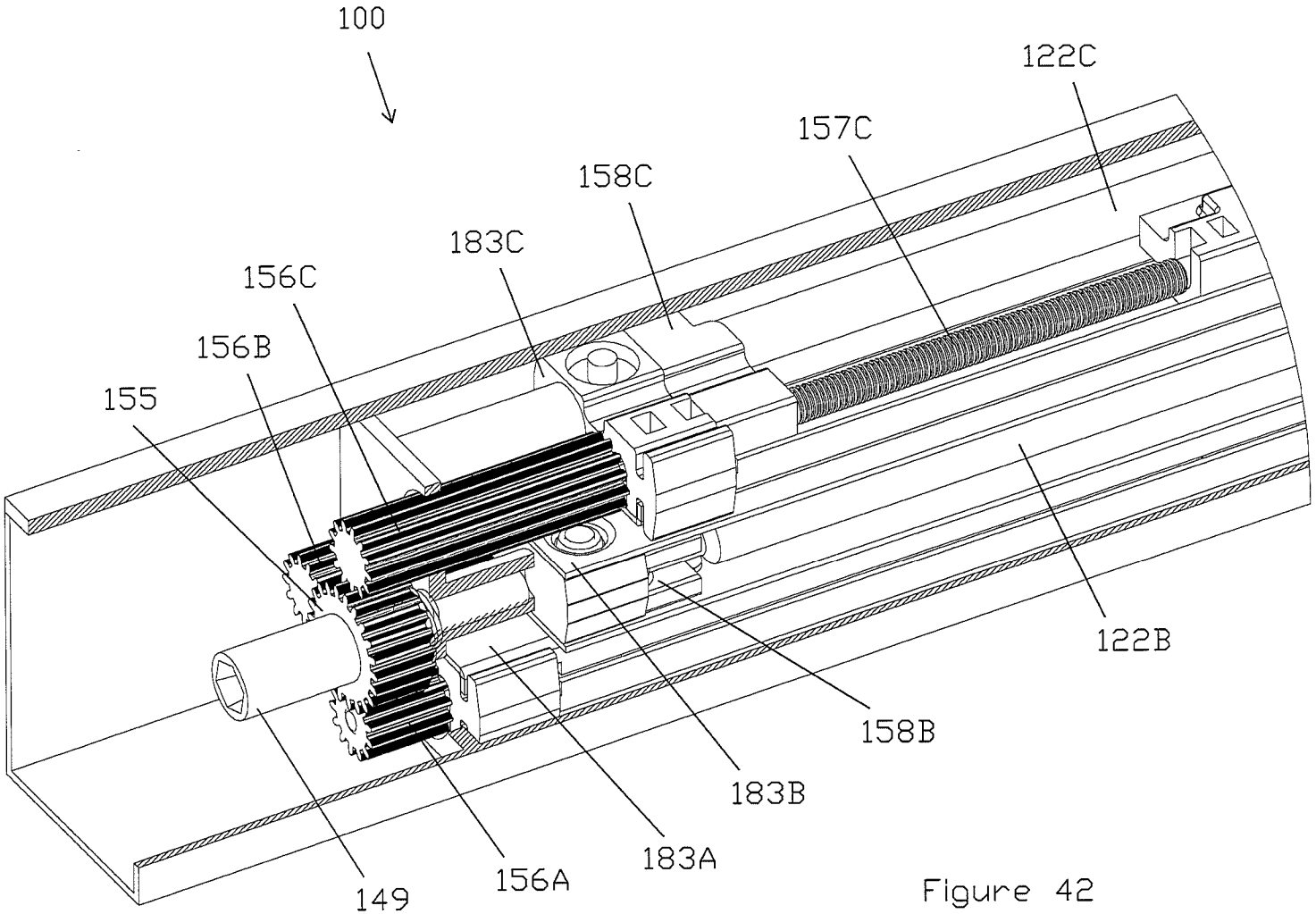
FIG. 42 is a view of an alternative embodiment of the closure mechanism having an adjustable resilient mechanism, illustrating the adjustment mechanism engaged and adjusted to provide the most tension.
Figure 43:
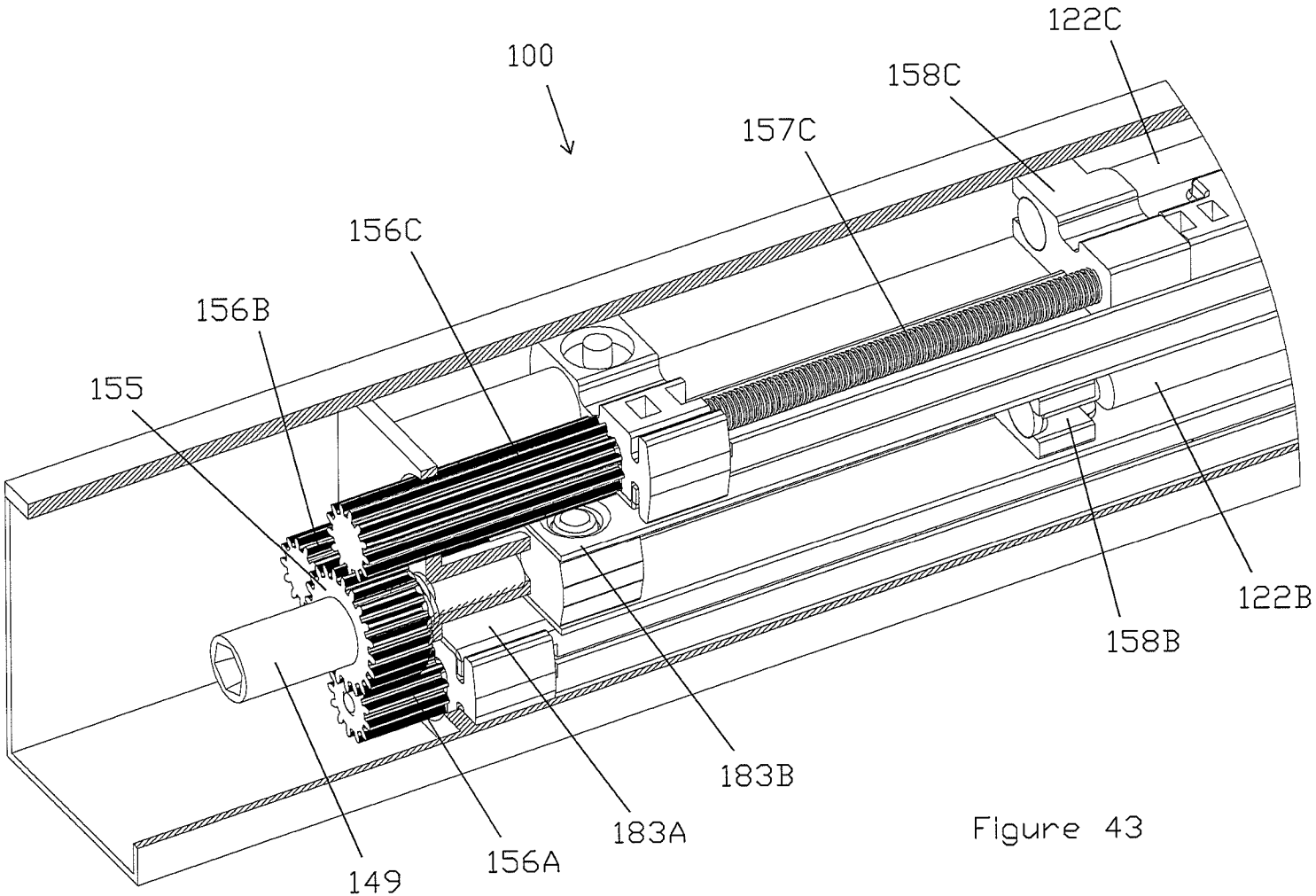
FIG. 43 is a view of an alternative embodiment of the closure mechanism having an adjustable resilient mechanism, illustrating the adjustment mechanism engaged and adjusted to provide the least tension.
Figure 44:
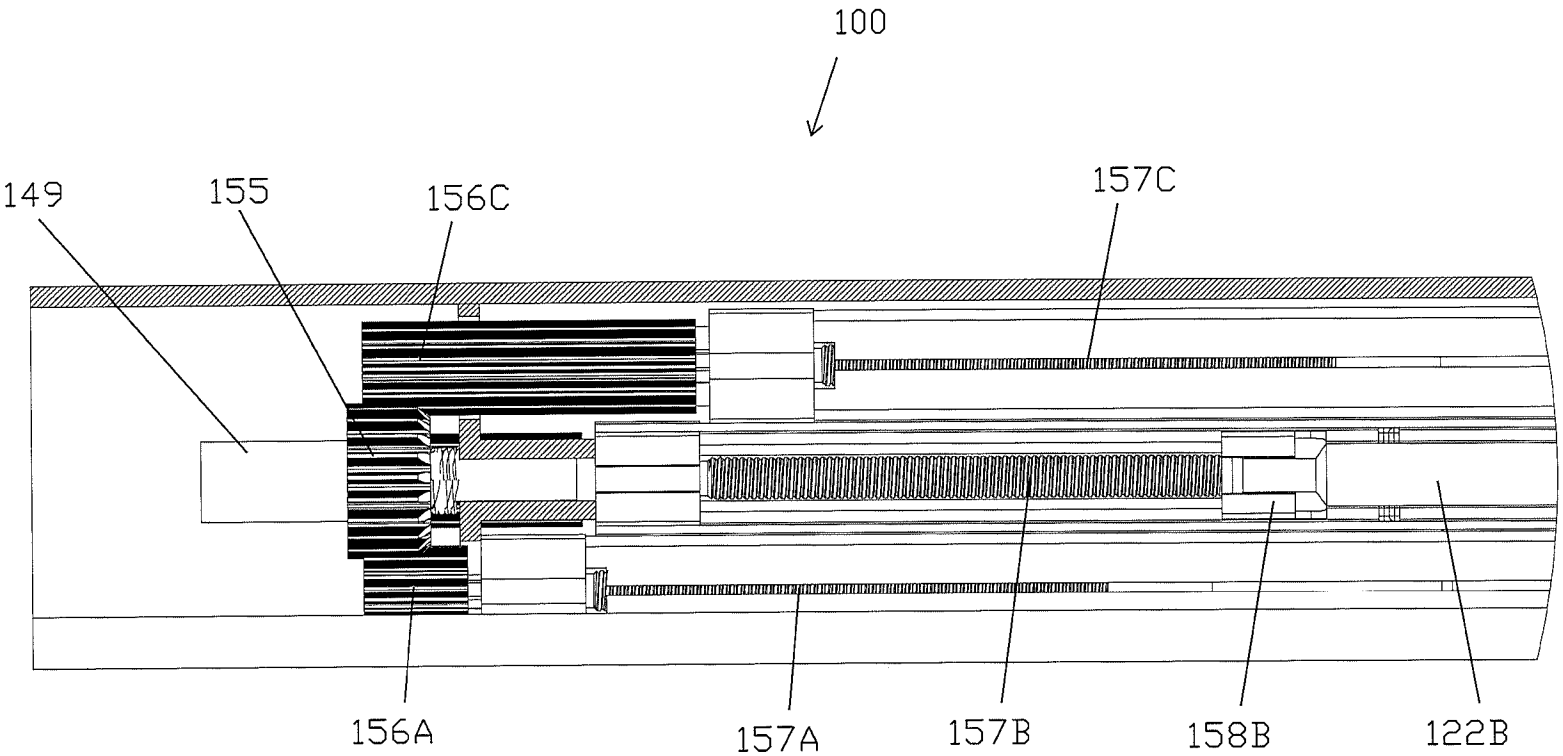
FIG. 44 is a front view of an alternative embodiment of the closure mechanism having an adjustable resilient mechanism, illustrating the adjustment mechanism engaged and adjusted to provide the least tension.
Figure 45:
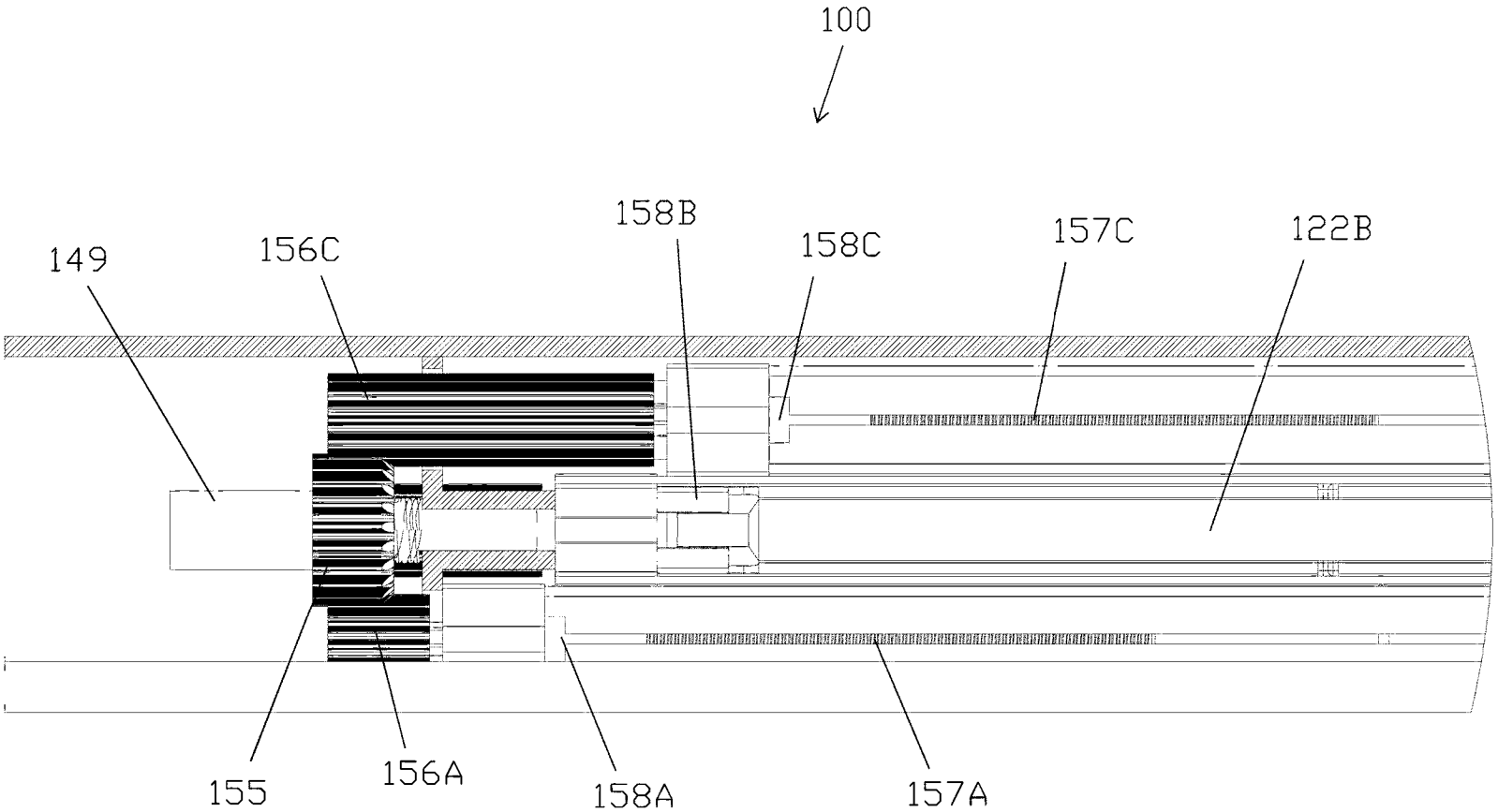
FIG. 45 is a front view of an alternative embodiment of the closure mechanism having an adjustable resilient mechanism, illustrating the adjustment mechanism engaged and adjusted to provide the most tension.

To adjust the tension, mechanism 153 is forced, typical using a tool and the drive gear 155 is engaged with the driven gears 156A, 156B and 156C as seen in FIGS. 42 to 44. Thus the tension on all resilient mechanisms 122 can be adjusted simultaneous and equally.

Further the configurable closing mechanism 100 may allow various subassemblies to be used including:

- a subassembly to pull the door closed (i.e. subassembly with resilient member in tension);
- a subassembly to control the speed at which the door closes—reduces the risk of the door pinching fingers or damaging the frame (i.e. a subassembly with damper);
- a subassembly to pull the door open (i.e. a subassembly with resilient member in tension, the subassembly orientation reversed 180 degrees from the subassembly that pulls the door closed);
- a subassembly to control the speed at which the door opens—reduces the risk of the door damaging the frame (i.e. a subassembly with a damper, the subassembly orientation reversed 180 degrees from the subassembly that controls the speed at which the door closes);

a subassembly to pull the door closed (i.e. a subassembly with resilient member in compression, the subassembly orientation reversed 180 degrees);

a subassembly to pull the door open (i.e. a subassembly with resilient member in compression);

a subassembly with a mechanical, electronic or other link to air-conditioning or heating unit to operate the air-conditioning or heating unit—if the door is closed the air-conditioning or heating unit will turn on, if door is not closed then air-conditioning or heating unit will turn off;

a subassembly with a mechanical, electronic or other link to an alarm system—when door is closed the door will automatically be alarmed;

a subassembly with a mechanical, electronic or other link to an alarm system—homeowner cannot set alarm if door is not closed;

a subassembly cassette to control the amount of force required and/or control the speed at which the door moves (i.e. replace the resilient member and damper with motorised equivalents);

a subassembly with a mechanical, electronic or other link to special glass material in a door which changes from transparent to opaque depending on whether the door is closed or not;

a subassembly with a lock, to lock the door open or closed;

a subassembly with a switch connected to some other device; or a multipurpose subassembly.

Such subassemblies could be used in various combination for example to allow a user to move the door to a closed position and lock the door. Such action could be done remotely or locally using a smart wireless device or locally using a simple switch. Each of the subassemblies would be configured to perform the function for which it is used.

It is further envisaged that a kit set of the base and various subassemblies could be supplied, or the base and the various subassemblies could be supplied separately and an installer could configure a closure by selecting the appropriate subassemblies as needed.

While the present invention has been illustrated by the description of the embodiments thereof, and while the embodiments have been described in detail, it is not the intention of the Applicant to restrict or in any way limit the scope of the appended claims to such detail. Further, the above embodiments may be implemented individually, or may be combined where compatible. Additional advantages and modifications, including combinations of the above embodiments, will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A closure mechanism comprising:

a base;

a carriage movable along the base;

a catching mechanism movable along the carriage;

a first resilient mechanism connecting the base and the catching mechanism;

a second resilient mechanism connecting the carriage and the catching mechanism; and a linking mechanism connected to the catching mechanism;

wherein the first resilient mechanism connects to the catching mechanism via the linking mechanism.

2. The closure mechanism as claimed in claim 1 further comprising linkage catching mechanism connectable to the linking mechanism and wherein the first resilient mechanism connects to the linking mechanism via the latching mechanism.

3. The closure mechanism as claimed in claim 2 further comprising a damping mechanism for damping movement of the linkage catching mechanism in at least one direction along the base.

4. The closure mechanism as claimed in claim 3 wherein the damping mechanism has a fixed end and a free end, the free end of the damping mechanism being connected to the linkage catching mechanism.

5. The closure mechanism as claimed in claim 1 wherein the first resilient mechanism is selected from the group consisting of at least one spring and at least two springs; and the second resilient mechanism is selected from the group consisting of at least one spring and at least two springs.

6. The closure mechanism as claimed in claim 1 wherein the closure mechanism is operable to position a positionable object.

7. The closure mechanism as claimed in claim 1 wherein the closure mechanism is operable to close a closable object within a body and wherein the closure mechanism catching mechanism cooperates with a catch trigger to close the closable object.

8. The closure mechanism as claimed in claim 7 wherein the closable object is selected from the group consisting of a door, a window, a partition, a gate and a drawer.

9. The closure mechanism as claimed in claim 1 further including a resilient force adjusting mechanism for simultaneously adjusting the tension of all the resilient mechanisms wherein the resilient force adjusting mechanism includes:

a driven gear associated with each resilient mechanism configured to adjust the tension of the associated resilient mechanism; and at least one drive gear engageable with the driven gears of the resilient mechanisms, the at least one drive gear operable to simultaneously adjust the tension of all the resilient mechanisms, each at least one drive gear is movable from a first position in which it is engaged with the driven gears to a second position in which it is disengaged from the driven gears and wherein the drive gear is biased towards the disengaged position.

10. A closure mechanism comprising:

an elongated member;

a catch slidable along the elongated member; and a force providing mechanism operable to provide a force to the catch as the catch slides along the elongated member, wherein the maximum force provided by the force providing mechanism in a first direction is greater than the maximum force provided by the force providing mechanism in the second opposite direction;

wherein the force providing mechanism includes at least two resilient mechanisms and wherein in a first direction all of the at least two resilient mechanisms operate together to provide a force and in the second direction each of the at least two resilient mechanisms operate separately, each resilient mechanism providing force for only part of the slide in the second direction.

11. The closure mechanism as claimed in claim 10 further comprising a damper operable to dampen the force applied to the catch in the first direction.

12. The closure mechanism as claimed in claim 11 wherein the closure mechanism is operable to position a positionable object.

13. The closure mechanism as claimed in claim 10 further including a resilient force adjusting mechanism for simultaneously adjusting the tension of all the resilient mechanisms wherein the resilient force adjusting mechanism includes:

a driven gear associated with each resilient mechanism configured to adjust the tension of the associated resilient mechanism; and at least one drive gear engageable with the driven gears of the resilient mechanisms, the at least one drive gear operable to simultaneously adjust the tension of all the resilient mechanisms, each at least one drive gear is movable from a first position in which it is engaged with the driven gears to a second position in which it is disengaged from the driven gears and wherein the drive gear is biased towards the disengaged position.

14. A closing device for a panel comprising:

a base; the base having:

first and second ends; and a guide path, the guide path extending at least partially from the first end to the second end of the base;

a carriage, wherein the carriage is movable along the first guide path, the carriage having;

first and second ends; and a carriage guide path, the carriage guide path extending at least partially from the first end to the second end of the carriage;

a catching mechanism, wherein the catching mechanism is movable along on the carriage guide path;

a connecting link having first and second ends, wherein the catching mechanism is connected to the connecting link at the second end;

a first resilient mechanism;

a linkage catching mechanism connectable with the first end of the connecting link, the first resilient mechanism connecting to the connecting link via the linkage catching mechanism;

a second resilient mechanism connecting the first end of the carriage and the catching mechanism; and a damping mechanism, for damping movement of the catching mechanism as it moves towards the first end of the base.

15. The closing device for a panel as claimed in claim 14 further including at least one third resilient mechanism connectable to the catching mechanism.

16. The closing device for a panel as claimed in claim 14 wherein the damping mechanism has a fixed end and a free end, the free end of the damping mechanism being connected to the linkage catching mechanism.

17. The closing device for a panel as claimed in claim 14 wherein the closing device is operable to position the panel.

18. The closing device for a panel as claimed in claim 14 further including a resilient force adjusting mechanism for simultaneously adjusting the tension of all the resilient force mechanisms wherein the resilient force adjusting mechanism includes:

a driven gear associated with each resilient mechanism configured to adjust the tension of the associated resilient mechanism; and at least one drive gear engageable with the driven gears of the resilient mechanisms, the at least one drive gear operable to simultaneously adjust the tension of all the resilient mechanisms, each at least one drive gear is movable from a first position in which it is engaged with the driven gears to a second position in which it is disengaged from the driven gears and wherein the drive gear is biased towards the disengaged position.

* * * * *